US010990051B2

(12) United States Patent
Omata et al.

(10) Patent No.: US 10,990,051 B2
(45) Date of Patent: Apr. 27, 2021

(54) IMAGE FORMING APPARATUS OUTPUTTING PLURAL TEST TONER IMAGES FOR USE IN ADJUSTING TRANSFER VOLTAGE

(71) Applicant: CANON KABUSHIKI KAISHA, Tokyo (JP)

(72) Inventors: Haruhiko Omata, Abiko (JP); Tatsuomi Murayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/688,228

(22) Filed: Nov. 19, 2019

(65) Prior Publication Data

US 2020/0166881 A1 May 28, 2020

(30) Foreign Application Priority Data

Nov. 22, 2018 (JP) ..... JP2018-219771

(51) Int. Cl.
*G03G 15/00* (2006.01)

(52) U.S. Cl.
CPC ..... *G03G 15/5058* (2013.01); *G03G 15/5041* (2013.01); *G03G 15/5095* (2013.01); *G03G 2215/00067* (2013.01); *G03G 2215/00734* (2013.01)

(58) Field of Classification Search
CPC ..... G03G 15/5058; G03G 15/5041; G03G 2215/00037; G03G 2215/00067; G03G 2215/00734; G03G 15/5095
See application file for complete search history.

(56) References Cited

U.S. PATENT DOCUMENTS 8,964,246 B2 * 2/2015 Sakatani ..... G03G 15/0131 345/590
9,930,191 B2 3/2018 Fujiki
10,180,641 B2 1/2019 Itagaki
2012/0050771 A1 * 3/2012 Sakatani ..... H04N 1/00053 358/1.9

(Continued)

FOREIGN PATENT DOCUMENTS

JP 2000-221803 A 8/2000
JP 2017-072689 A 4/2017
JP 2017-227784 A 12/2017

OTHER PUBLICATIONS

U.S. Appl. No. 16/748,411, filed Jan. 21, 2020, Haruhiko Omata.
U.S. Appl. No. 16/748,428, filed Jan. 21, 2020, Haruhiko Omata.

*Primary Examiner* — Walter L Lindsay, Jr.
*Assistant Examiner* — Laura Roth
(74) *Attorney, Agent, or Firm* — Venable LLP

(57) ABSTRACT

An image forming apparatus includes an image bearing member, an image transfer device for transferring a toner image from the image bearing member to a sheet, an application device for applying a transfer voltage to the image transfer device, and a controller for controlling an output mode operation for outputting a predetermined chart in which test halftone toner images transferred with different transfer voltages are formed to adjust the transfer voltage. When outputting a maximum size of the chart, the controller forms the test toner images in a region within 50 mm from an edge in a width direction perpendicular to a feeding direction of the sheet.

13 Claims, 17 Drawing Sheets

(56) References Cited

U.S. PATENT DOCUMENTS

| | | | | |
|---|---|---|---|---|
| 2013/0039673 | A1* | 2/2013 | Nakao | G03G 15/6561 399/49 |
| 2014/0133875 | A1* | 5/2014 | Harashima | G03G 15/5062 399/49 |
| 2017/0041510 | A1* | 2/2017 | Sakatani | H04N 1/2392 |
| 2017/0195500 | A1* | 7/2017 | Sugimoto | H04N 1/405 |
| 2017/0374207 | A1* | 12/2017 | Fujiki | H04N 1/00005 |
| 2019/0025722 | A1* | 1/2019 | Kojima | G03G 9/09725 |
| 2019/0107797 | A1 | 4/2019 | Murayama et al. | |
| 2020/0089151 | A1* | 3/2020 | Yoshino | G03G 15/5062 |

* cited by examiner

IMAGE FORMING APPARATUS OUTPUTTING PLURAL TEST TONER IMAGES FOR USE IN ADJUSTING TRANSFER VOLTAGE

FIELD OF THE INVENTION AND RELATED ART

The present invention relates to an image forming apparatus such as a copying machine, a printer, a facsimile machine using an electrophotographic type process or an electrostatic recording system, and a multi-function machine having a plurality of these functions.

In an image forming apparatus using an electrophotographic type process or the like, a toner image formed on an image bearing member such as a photosensitive member or an intermediary transfer member is transferred onto a recording material. The transfer of a toner image from an image bearing member to a recording material is often performed by applying a transfer voltage to a transfer member such as a transfer roller which contacts the image bearing member to form a transfer portion. Transfer voltage can be determined based on a transfer portion part voltage corresponding to the electrical resistance of the transfer portion detected during the pre-rotation process before image formation, and a recording material part voltage depending on the type of recording material set in advance. By this, an appropriate transfer voltage can be set according to the environmental fluctuations, the transfer member usage history, the recording material type, and the like. However, there are various types and conditions of recording materials used in the image formation, and therefore, the preset recording material part voltage may be higher or lower than the appropriate transfer voltage.

Under the circumstances, it is proposed that an adjustment mode is provided to adjust the transfer voltage according to the recording material actually used in the image formation. Japanese Laid-open Patent Application No. 2000-221803 proposes an image forming apparatus operable in an adjustment mode for adjusting the secondary transfer voltage. In this adjustment mode, a diagnostic chart with multiple patches on one recording material is outputted while switching the transfer voltage for each patch. And, production of image defects in the outputted diagnostic chart patch is checked, and the transfer voltage is adjusted to an optimum level. The chart output in the adjustment mode of JP-A-2000-221803 is as shown in part (a) of FIG. 17, in which a plurality of patches are provided in the central part of the recording material with a relatively large margin at the end of the recording material.

Problems to be Solved by the Invention

However, it is found that even if the transfer voltage is adjusted using the chart as in the conventional adjustment mode, an image defect may occur at the end of the recording material depending on the type and state of the recording material used for image formation.

For example, depending on the type and state of the recording material, an image defect is likely to occur on an image (particularly a halftone image) formed on the end portion of the recording material. This phenomenon is not limited to these cases, but occurs for the following reasons. The moisture at the end of the recording material is easy to escape, and therefore, in some cases, the electrical resistance increases only at the end of the recording material, and abnormal discharge is likely to occur during the image transfer operation. On the other hand, there is a case in which the moisture is absorbed only at the end portion of the recording material, and the end portion of the recording material is undulated, and the behavior of the undulating portion during feeding of the recording material is unstable, with the result of causing abnormal electrical discharge during the image transfer operation. In such a case, even if the transfer voltage is adjusted using a chart having the patches only in the central portion of the recording material, an image defect may occur at the end portion of the recording material.

SUMMARY OF THE INVENTION

Therefore, an object of the present invention is to provide an image forming apparatus capable of appropriately adjusting a transfer voltage even when a recording material which easily causes an image defect at an end portion is used.

According to an aspect of the present invention, there is provided an image forming apparatus comprising an image bearing member for carrying a toner image; an image transfer device configured to transfer the toner image from said image bearing member to a recording material; an application device configured to apply a transfer voltage for the image transfer to said image transfer device; and a controller configured to control an output mode operation for outputting a predetermined chart in which a plurality of test toner images transferred with different transfer voltages are formed to adjust the transfer voltage; wherein the plurality of test toner images are halftone images, and wherein when outputting a maximum size of the chart, the controller forms the plurality of test toner images in a region within 50 mm from an edge in a width direction perpendicular to a feeding direction of the recording material.

Further features of the present invention will become apparent from the following description of exemplary embodiments with reference to the mounted drawings.

Figure 5:
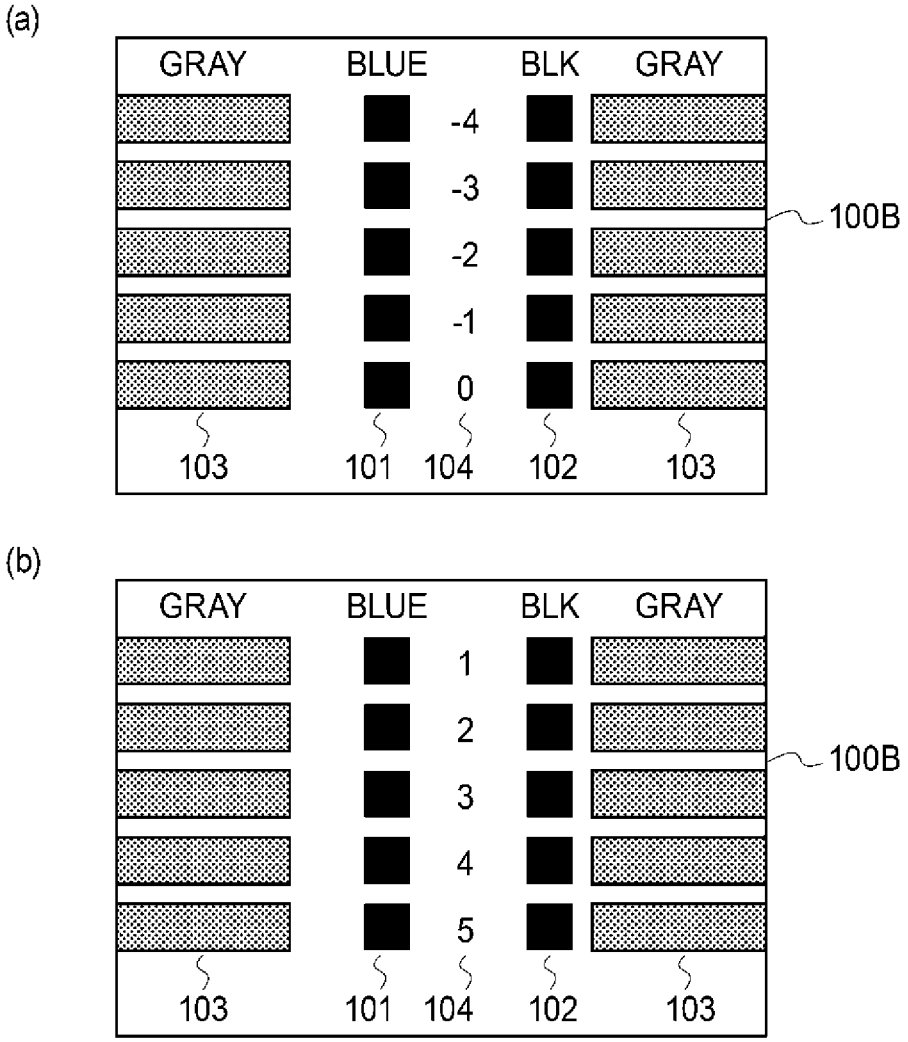

Parts (a) and (b) of FIG. 5 form a schematic illustration of the chart image data outputted in the adjustment mode.

Figure 6:
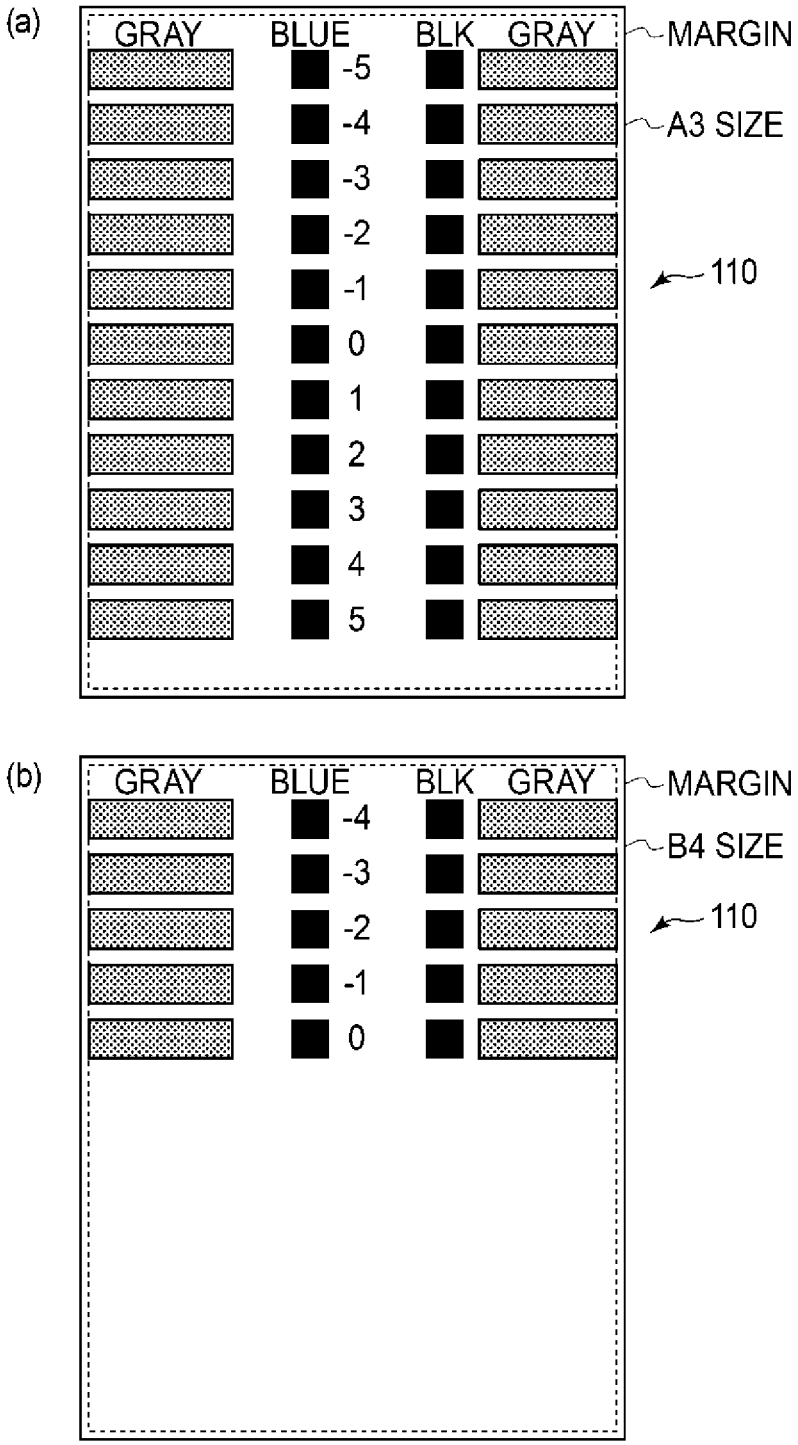

Parts (a) and (b) of FIG. 6 form a schematic illustration of the chart outputted in the adjustment mode.

Figure 7:
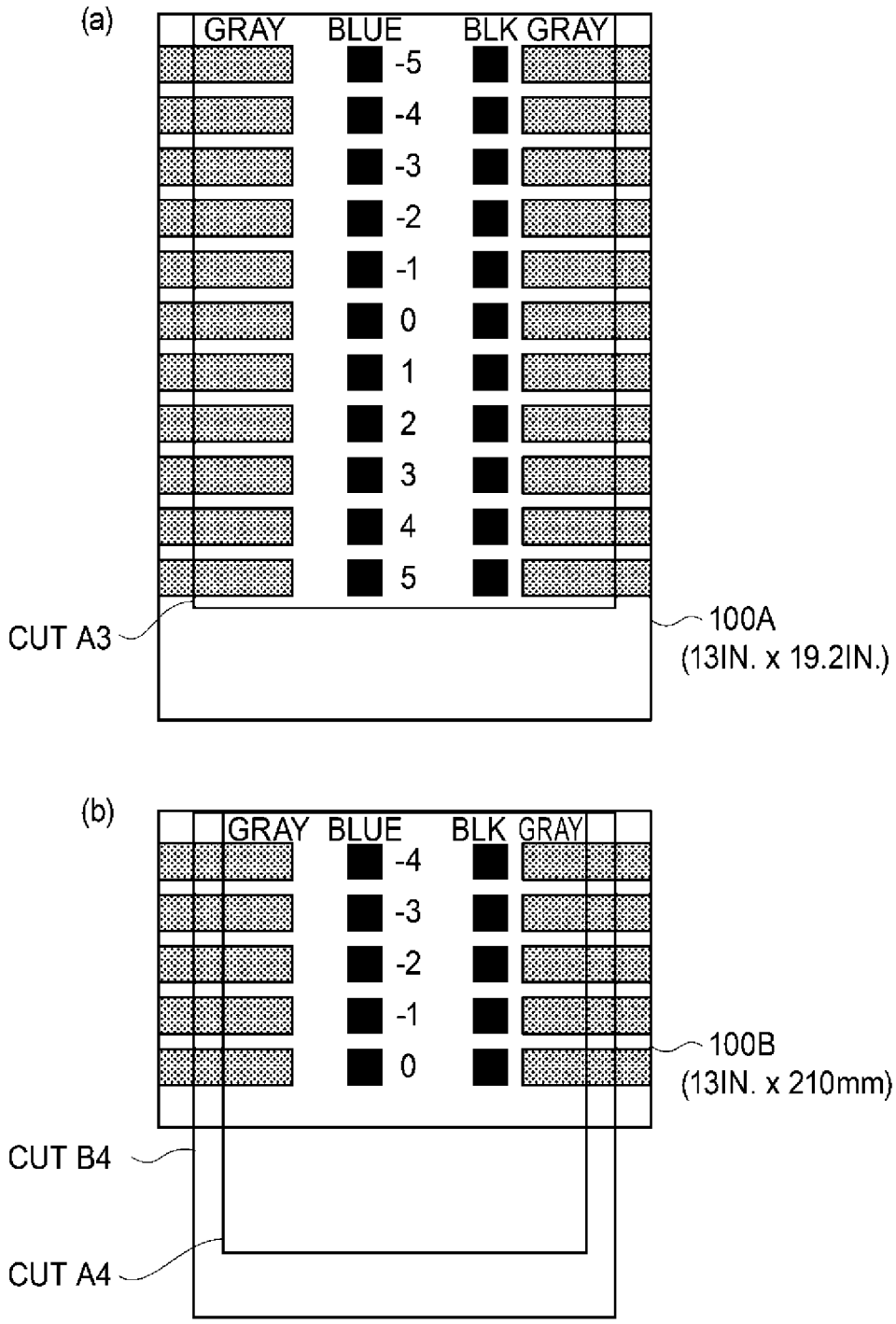

Parts (a) and (b) of FIG. 7 form a schematic illustration of cutting of the chart image data.

Figure 8:
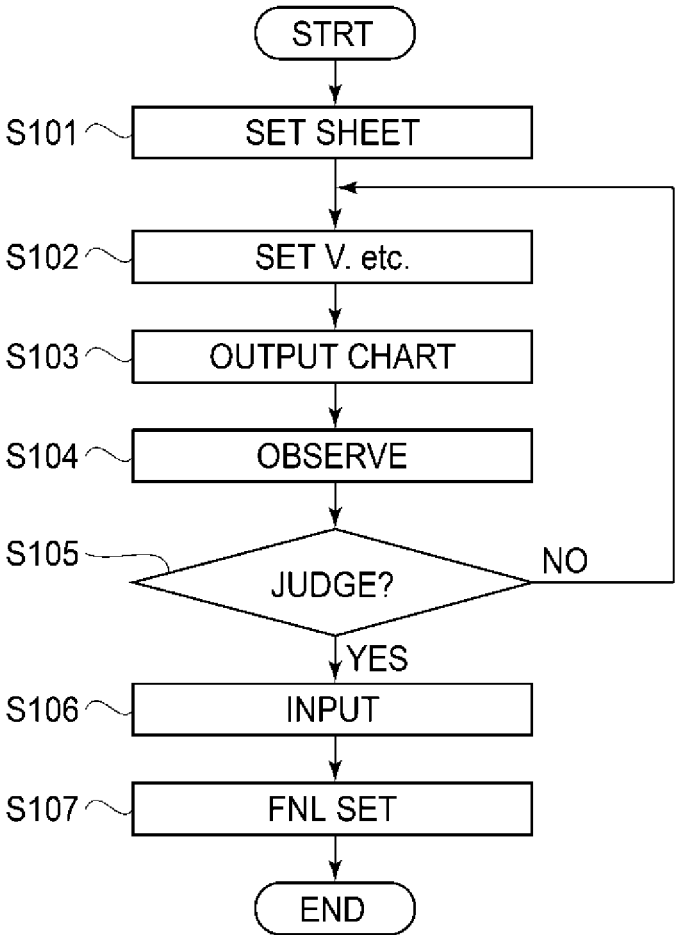

FIG. 8 is a flowchart showing an outline of the process in the adjustment mode.

Figure 9:
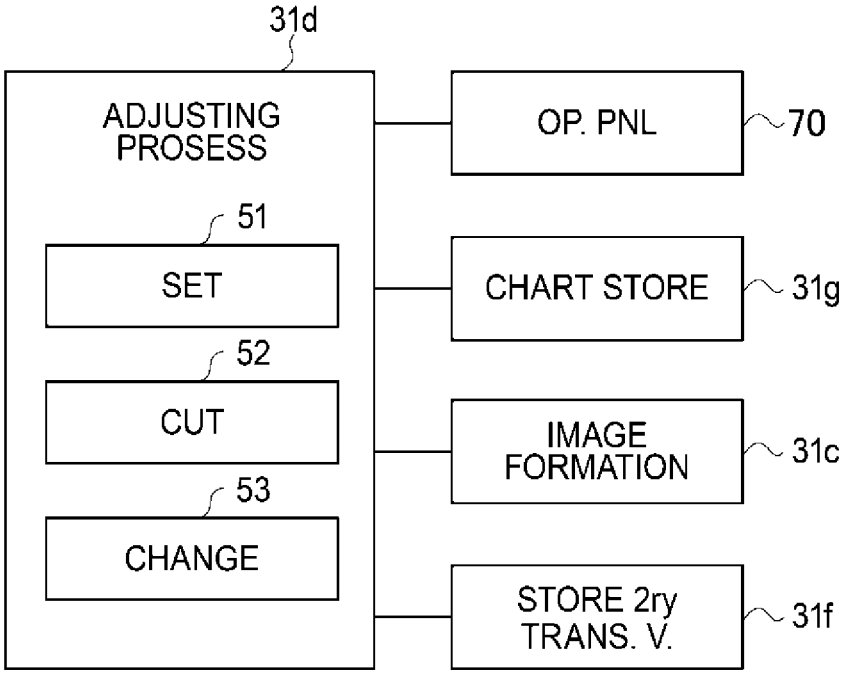

FIG. 9 is a functional block diagram illustrating the operation of the adjustment process portion.

Figure 10:
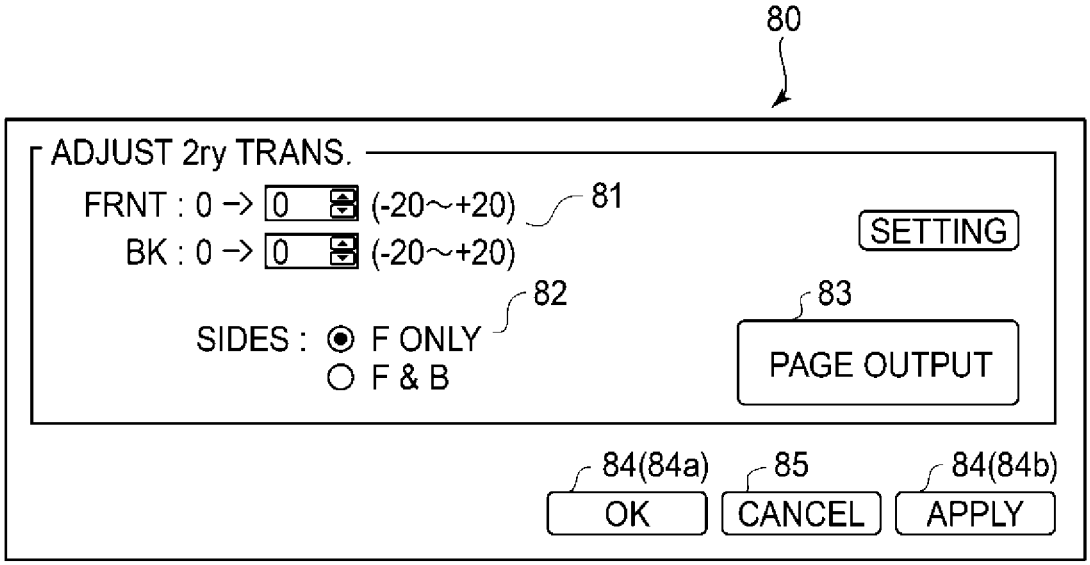

FIG. 10 is a schematic illustration of an adjustment mode setting screen.

Figure 11:
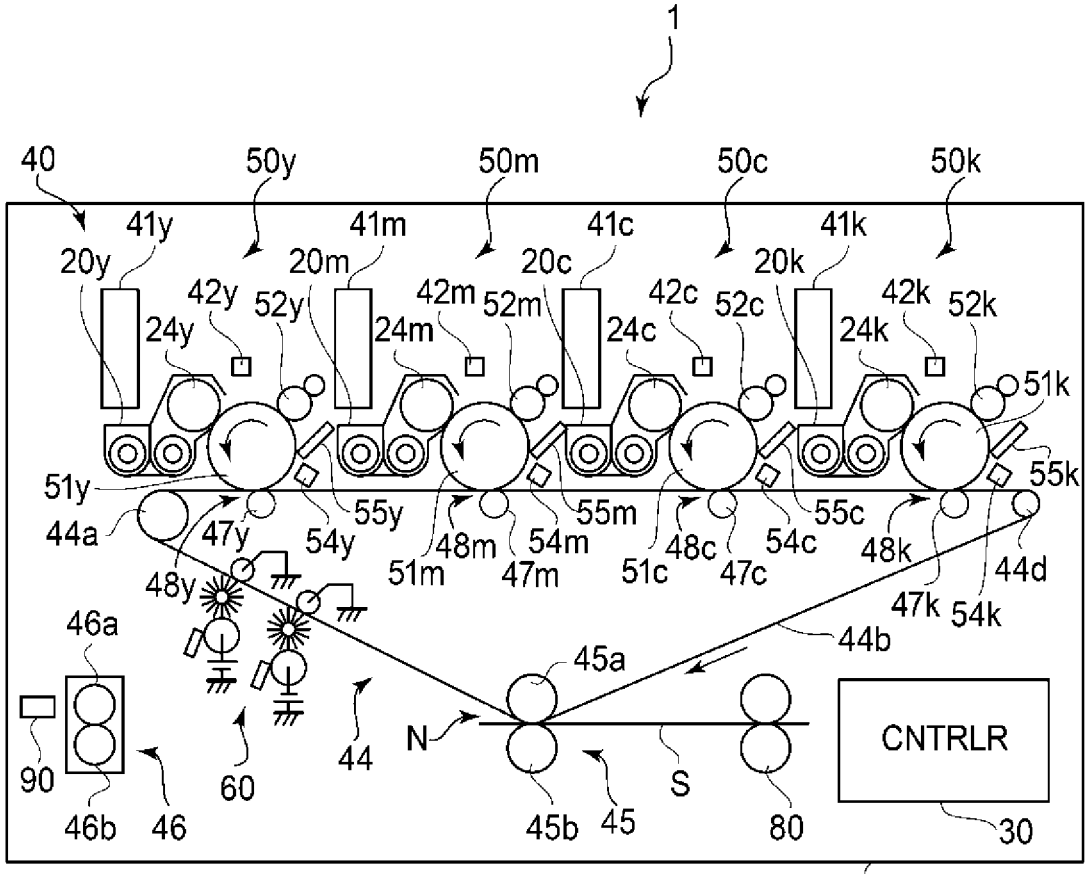

FIG. 11 is a schematic sectional view of another example of the image forming apparatus.

Figure 12:
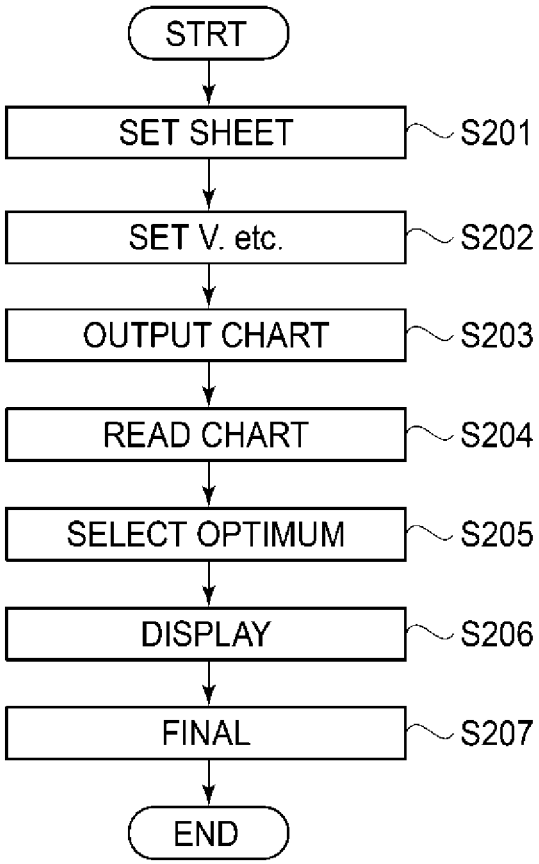

FIG. 12 is a flowchart showing an outline of the process in the adjustment mode of the other example.

Figure 13:
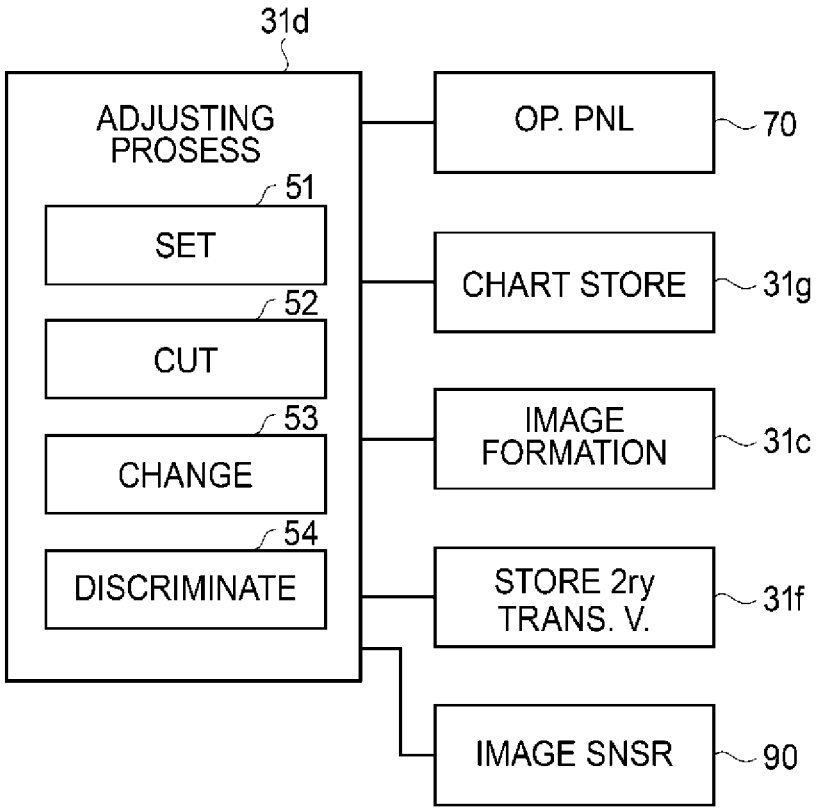

FIG. 13 is a functional block diagram illustrating the operation of the adjustment process portion of the other example.

Figure 14:
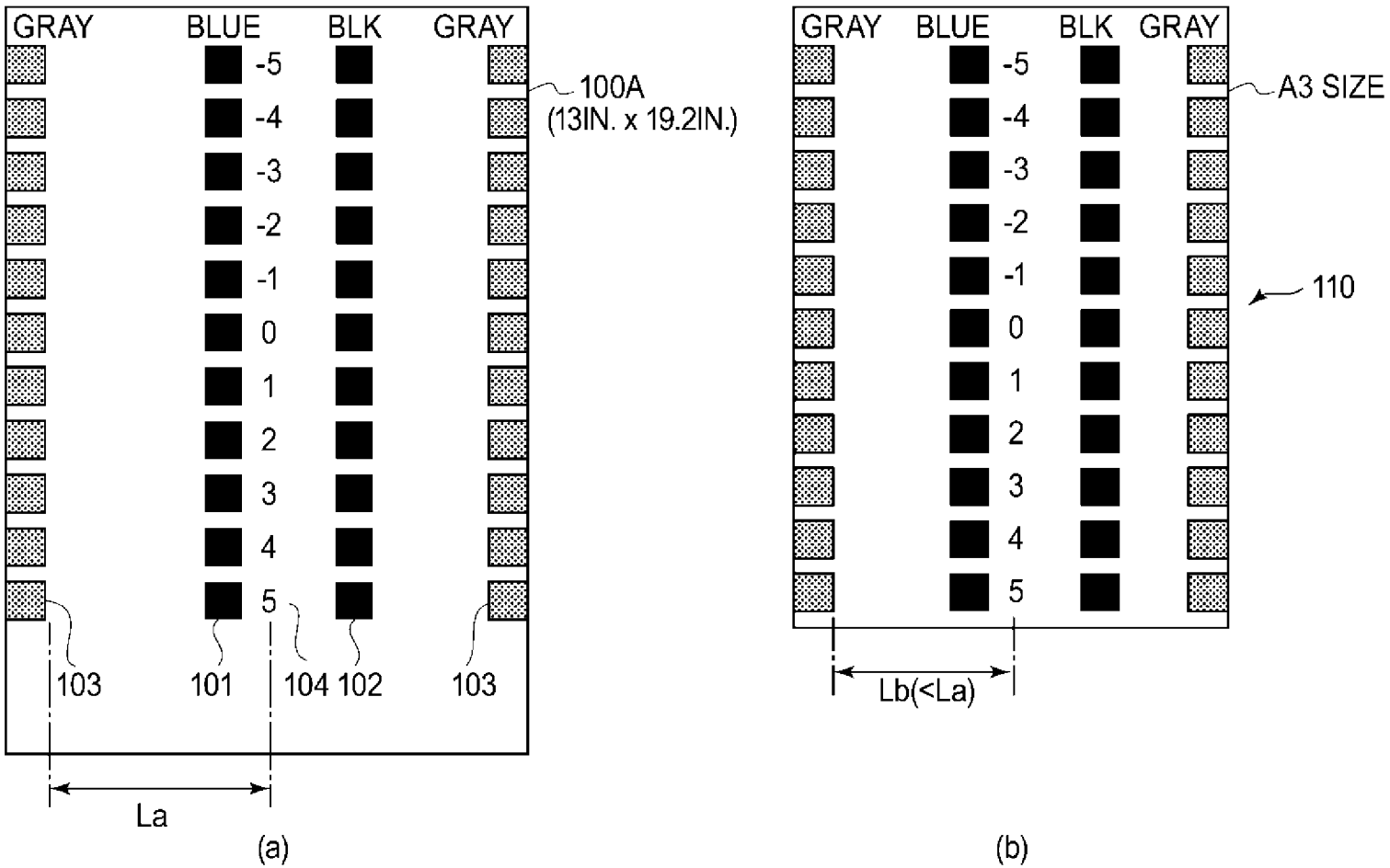

Parts (a) and (b) of FIG. 14 form a schematic illustration of a chart outputted in the adjustment mode of the other example.

Figure 15:
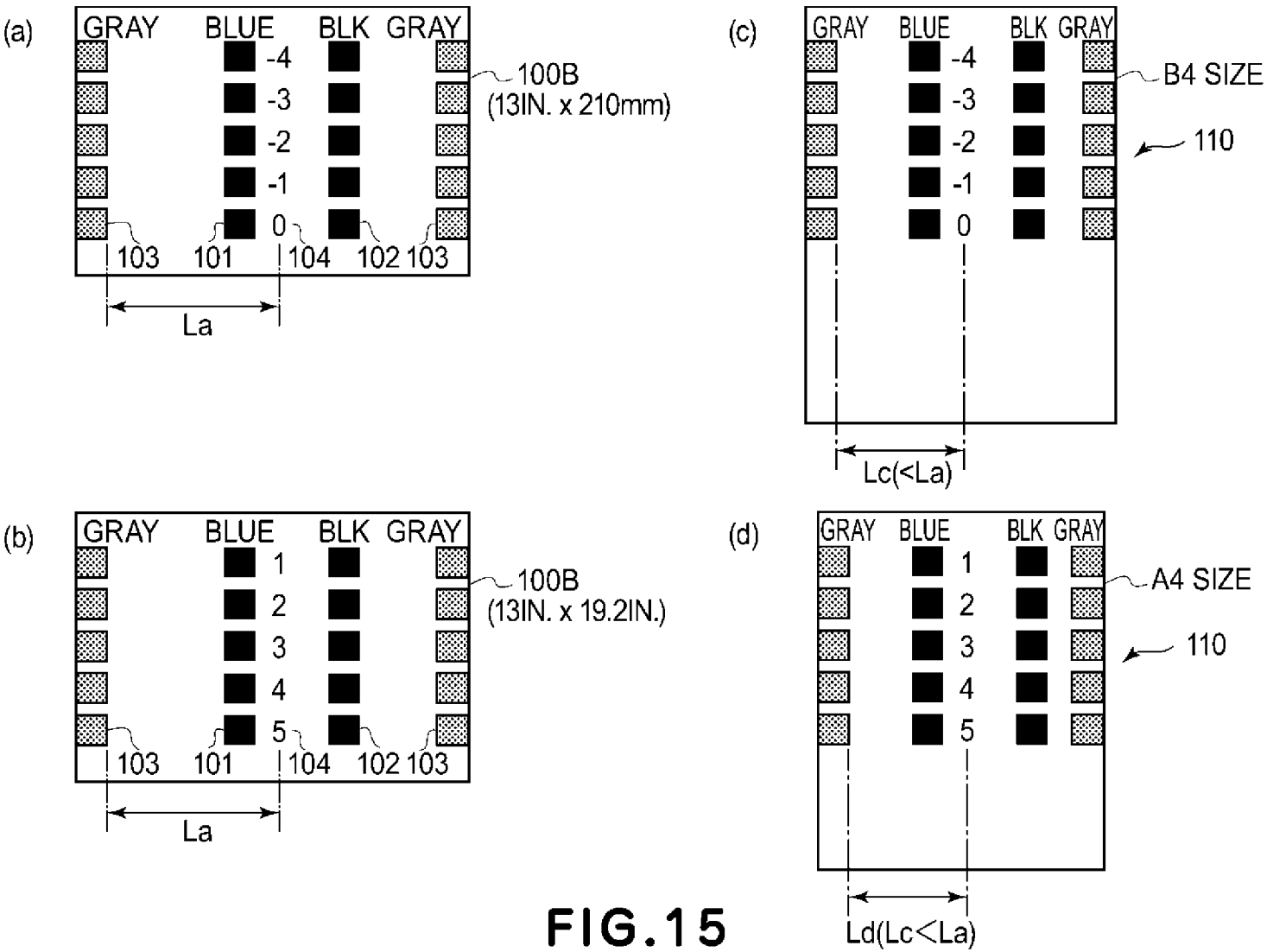

Parts (a), (b), (c) and (d) of FIG. 15 form a schematic illustration of a chart outputted in the adjustment mode of the other example.

Figure 16:
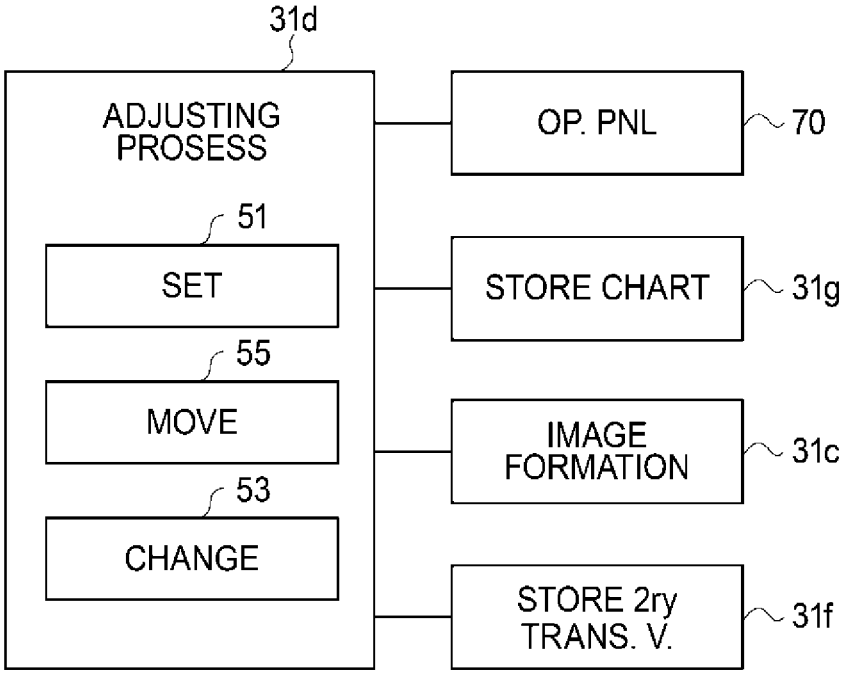

FIG. 16 is a functional block diagram illustrating the operation of the adjustment process portion of the other example.

Figure 17:
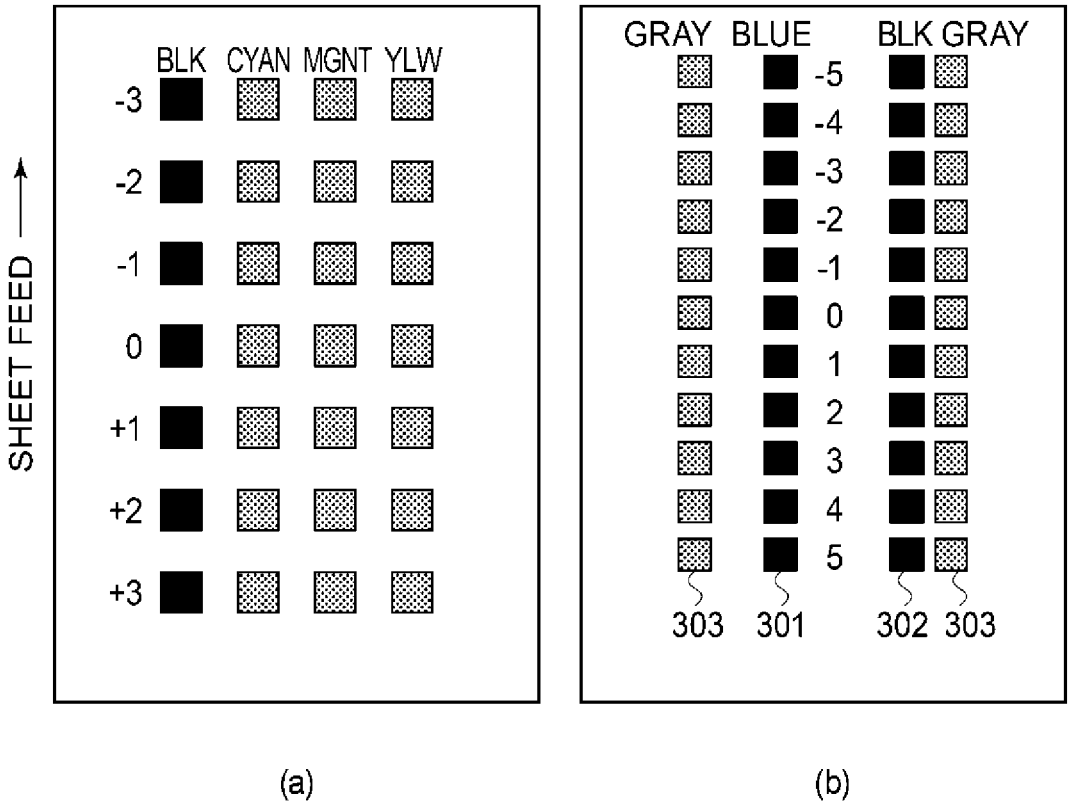

Parts (a) and (b) of FIG. 17 form a schematic illustration of the chart in the adjustment mode of a conventional example and a comparative example.

DESCRIPTION OF THE EMBODIMENTS

In the following, the image forming apparatus according to the present invention will be described in more detail with reference to the drawings.

Embodiment 1

1. Structure and Operation of Image Forming Apparatus.

Figure 1:
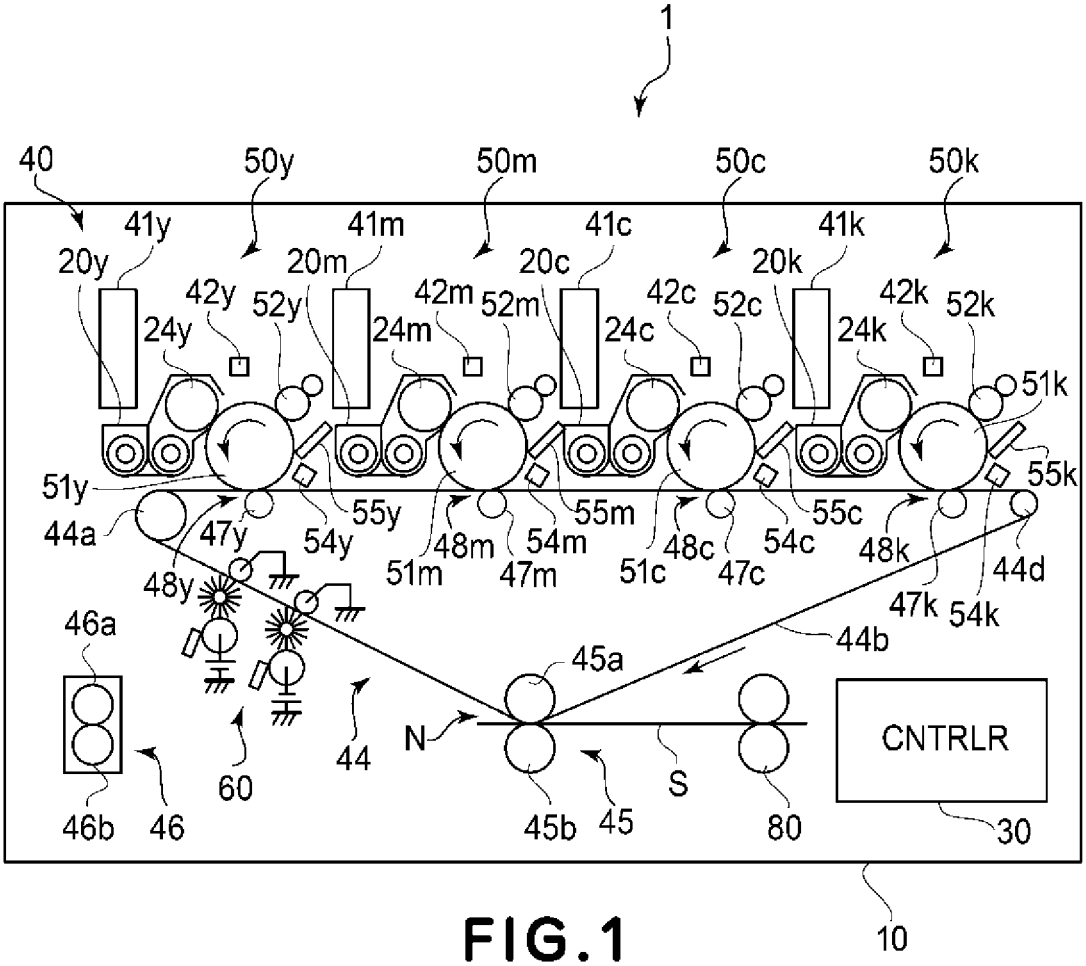
FIG. 1 is a schematic sectional view of an example of an image forming apparatus.

FIG. 1 is a schematic cross-sectional view of an image forming apparatus 1 of this embodiment. The image forming apparatus 1 of this embodiment is a tandem type full-color printer. However, the image forming apparatus of the present invention is not limited to a tandem type image forming apparatus, and may be an image forming apparatus of another type. In addition, the image forming apparatus is not limited to an image forming apparatus capable of forming a full-color image, and may be an image forming apparatus capable of forming only a monochromatic image.

Figure 2:
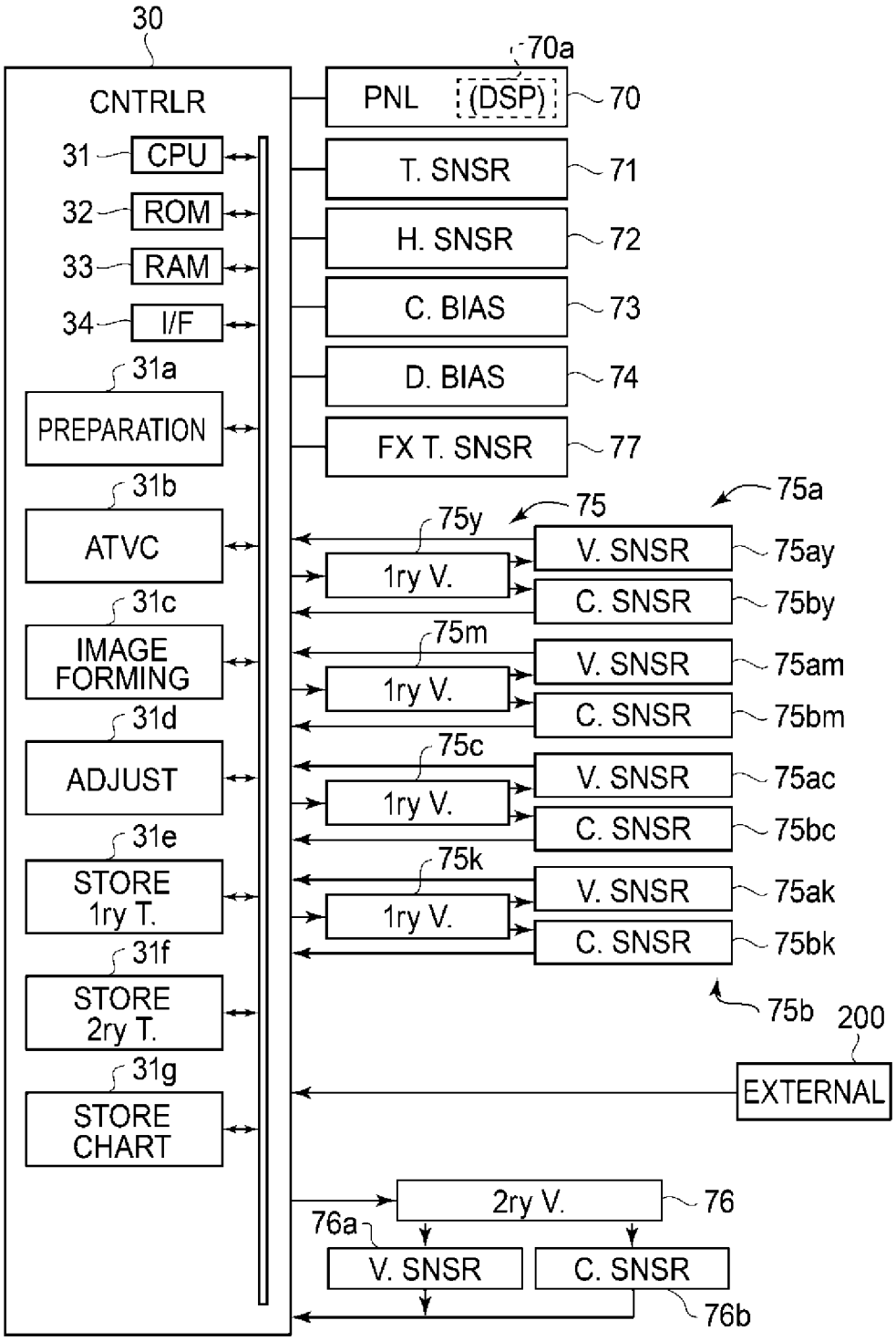
FIG. 2 is a block illustration showing a schematic structure of a control system of the image forming apparatus.

As shown in FIG. 1, the image forming apparatus 1 comprises an apparatus main assembly 10, a feeding portion (not shown), an image forming portion 40, a discharge portion (not shown), a controller 30, and an operation portion 70 (FIG. 2). Inside the apparatus main assembly 10 are provided a temperature sensor 71 (FIG. 2) capable of detecting the temperature inside the apparatus and a humidity sensor 72 (FIG. 2) capable of detecting the humidity inside the apparatus. The image forming apparatus 1 can form 4-color full-color images on recording material (sheet, transfer material) S, in accordance with image signals supplied from an original reading device (not shown), a host device such as personal computer and an external device 200 (FIG. 2) such as digital camera or smartphone. Here, the recording material S is the material on which a toner image is formed, and specific examples thereof include plain paper, synthetic resin sheets which are substitutes for plain paper, cardboard, and overhead projector sheets.

The image forming portion 40 can form the image on the recording material S fed from the feeding portion on the basis of the image information. The image forming portion 40 comprises an image forming units 50*y*, 50*m*, 50*c*, 50*k*, toner bottles 41*y*, 41*m*, 41*c*, 41*k*, exposure devices 42*y*, 42*m*, 42*c*, 42*k*, an intermediary transfer unit 44, and a secondary transfer device 45, and a fixing portion 46. The image forming units 50*y*, 50*m*, 50*c*, and 50*k* form yellow (y), magenta (m), cyan (c), and black (k) images, respectively. Elements having the same or corresponding functions or structures provided for these four image forming units 50*y*, 50*m*, 50*c*, and 50*k* may be referred to, with y, m, c and k omitted, in the case that the description applies to all colors. Here, the image forming apparatus 1 can also form a single-color or multi-color image by using an image forming unit 50 for a desired single color or some of four colors, such as a monochromatic black image.

The image forming unit 50 includes the following means. First, a photosensitive drum 51 which is a drum-type (cylindrical) photosensitive member (electrophotographic photosensitive member) as a first image bearing member is provided. In addition, a charging roller 52, which is a roller-type charging member, is used as charging means. In addition, a developing device 20 is provided as developing means. In addition, a pre-exposure device 54 is provided as a charge eliminating portion. In addition, a cleaning blade 55 which is a cleaning member as a photosensitive member cleaning member is provided. The image forming unit 50 forms a toner image on the intermediary transfer belt 44*b* which will be described hereinafter. The image forming unit 50 is unitized as a process cartridge and can be mounted to and dismounted from the apparatus main assembly 10.

The photosensitive drum 51 is movable (rotatable) carrying an electrostatic image (electrostatic latent image) or a toner image. In this embodiment, the photosensitive drum 51 is a negative charging property organic photosensitive member (OPC) having an outer diameter of 30 mm. The photosensitive drum 51 has an aluminum cylinder as a base material and a surface layer formed on the surface of the base material. In this embodiment, the surface layer comprises three layers of an undercoat layer, a photocharge generation layer, and a charge transportation layer, which are applied and laminated on the substrate in the order named. When the image forming operation is started, the photosensitive drum 51 is driven to rotate in a direction indicated by an arrow (counterclockwise) in the Figure at a predetermined process speed (circumferential speed) by a motor (not shown) as a driving means.

The surface of the rotating photosensitive drum 51 is uniformly charged by the charging roller 52. In this embodiment, the charging roller 52 is a rubber roller which contacts the surface of the photosensitive drum 51 and is rotated by the rotation of the photosensitive drum 51. The charging roller 52 is connected with a charging bias power source 73 (FIG. 2) The charging bias power source 73 applies a DC voltage as a charging bias (charging voltage) to the charging roller 52 during the charging process.

The surface of the charged photosensitive drum 51 is scanned and exposed by the exposure device 42 in accordance with the image information, so that an electrostatic image is formed on the photosensitive drum 51. The exposure device 42 includes a laser scanner in this embodiment. The exposure device 42 emits laser beam in accordance with the separated color image information outputted from the controller 30, and scans and exposes the surface (outer peripheral surface) of the photosensitive drum 51.

The electrostatic image formed on the photosensitive drum 51 is developed (visualized) by supplying the developer toner thereto by the developing device 20, so that a toner image is formed on the photosensitive drum 51. In this embodiment, the developing device 20 contains a two-component developer (also simply referred to as "developer") comprising non-magnetic toner particles (toner) and magnetic carrier particles (carrier). The toner is supplied from the toner bottle 41 to the developing device 20. The developing device 20 includes a developing sleeve 24. The developing sleeve 24 is made of a nonmagnetic material such as aluminum or nonmagnetic stainless steel (aluminum in this embodiment). Inside the developing sleeve 24, a magnet roller, which is a roller-shaped magnet, is fixed and arranged so as not to rotate relative to the main body (developing container) of the developing device 20. The developing sleeve 24 carries a developer and conveys it to a developing zone facing the photosensitive drum 51. A developing bias power source 74 (FIG. 2) is connected to the developing sleeve 24. The developing bias power source 74 applies a DC voltage as a developing bias (developing voltage) to the developing sleeve 24 during the developing process operation. In this embodiment, the normal charging polarity of the toner, which is the charging polarity of the toner during development, is negative.

An intermediary transfer unit 44 is arranged so as to face the four photosensitive drums 51*y*, 51*m*, 51*c*, 51*k*. The intermediary transfer unit 44 includes an intermediary transfer belt 44*b* as a second image bearing member. The intermediary transfer belt 44*b* is wound around a plurality of rollers such as a driving roller 44*a*, a driven roller 44*d*, primary transfer rollers 47*y*, 47*m*, 47*c*, 47*k*, and an inner secondary transfer roller 45*a*. The intermediary transfer belt 44*b* is movable (rotatable) carrying the toner image. The driving roller 44*a* is rotationally driven by a motor (not shown) as driving means, and rotates (circulates) the intermediary transfer belt 44*b*. The driven roller 44*d* is a tension roller which controls the tension of the intermediary transfer belt 44*b* to be constant. The driven roller 44*d* is subjected to a force which pushes the intermediary transfer belt 44*b* toward the outer peripheral surface by the urging force of a spring (not shown) as a biasing means, and by this force, a tension of about 2 to 5 kg is applied in the feeding direction of the intermediary transfer belt 44*b*. The inner secondary transfer roller 45*a* constitutes the secondary transfer device 45 as will be described hereinafter. The driving force is transmitted to the intermediary transfer belt 44*b* by the driving roller 44*a*, and the intermediary transfer belt 44*b* is rotationally driven in the arrow direction (clockwise) in the drawing at a predetermined peripheral speed corresponding to the peripheral speed of the photosensitive drum 51. In addition, the intermediary transfer unit 44 is provided with a belt cleaning device 60 as intermediary transfer member cleaning means.

The primary transfer rollers 47*y*, 47*m*, 47*c*, 47*k*, which are roller-type primary transfer members as primary transfer means, are arranged to face the photosensitive drums 51*y*, 51*m*, 51*c*, 51*k*, respectively. The primary transfer roller 47 holds the intermediary transfer belt 44*b* between the photosensitive drum 51 and the primary transfer roller 47. By this, the intermediary transfer belt 44*b* contacts the photosensitive drum 51 to form a primary transfer portion (primary transfer nip portion) 48 with the photosensitive drum 51.

The toner image formed on the photosensitive drum 51 is primarily transferred onto the intermediary transfer belt 44*b* by the action of the primary transfer roller 47 in the primary transfer portion 48. That is, in this embodiment, by applying a positive primary transfer voltage to the primary transfer roller 47, a negative toner image on the photosensitive drum 51 is primarily transferred onto the intermediary transfer belt 44*b*. For example, when forming a full-color image, the yellow, magenta, cyan, and black toner images formed on the photosensitive drums 51*y*, 51*m*, 51*c*, and 51*k* are transferred so as to be sequentially superimposed on the intermediary transfer belt 44*b*. A primary transfer power source 75 (FIG. 2) is connected to the primary transfer roller 47. The primary transfer power supply 75 applies a DC voltage having a polarity opposite to the normal charging polarity of the toner (positive polarity in this embodiment) as a primary transfer bias (primary transfer voltage) to the primary transfer roller 47 during the primary transfer process operation. The primary transfer power supply 75 is connected to a voltage detection sensor 75*a* which detects the output voltage and a current detection sensor 75*b* which detects the output current (FIG. 2). In this embodiment, the primary transfer power sources 75*y*, 75*m*, 75*c*, and 75*k* are provided for the primary transfer rollers 47*y*, 47*m*, 47*c*, and 47*k*, respectively, and the primary transfer voltages applied to the primary transfer rollers 47*y*, 47*m*, 47*c* and 47*k* can be individually controlled.

In this embodiment, the primary transfer roller 47 has an elastic layer of ion conductive foam rubber (NBR rubber) and a cored bar. The outer diameter of the primary transfer roller 47 is, for example, 15 to 20 mm. In addition, as the primary transfer roller 47, a roller having an electric resistance value of 1×10^5 to 1×10^1 (N/N (23° C., 50% RH) condition, 2 kV applied) can be preferably used.

In this embodiment, the intermediary transfer belt 44*b* is an endless belt having a three-layer structure including a base layer, an elastic layer, and a surface layer in the order named from the inner peripheral surface side. As the resin material constituting the base layer, a resin such as polyimide or polycarbonate, or a material containing an appropriate amount of carbon black as an antistatic agent in various rubbers can be suitably used. The thickness of the base layer is, for example, 0.05 to 0.15 [mm]. As the elastic material constituting the elastic layer, a material containing an appropriate amount of an ionic conductive agent in various rubbers such as urethane rubber and silicone rubber can be suitably used. The thickness of the elastic layer is 0.1 to 0.500 [mm], for example. As a material constituting the surface layer, a resin such as a fluororesin can be suitably used. The surface layer has small adhesive force of the toner to the surface of the intermediary transfer belt 44*b* and makes it easier to transfer the toner onto the recording material S at the secondary transfer portion N. The thickness of the surface layer is, for example, 0.0002 to 0.020 [mm]. In this embodiment, for the surface layer, one kind of resin material such as polyurethane, polyester, epoxy resin, or two or more kinds of elastic materials such as elastic material rubber, elastomer, butyl rubber, for example, is used as a base material. And, as a material for reducing the surface energy and improving the lubricity of this base material, powder or particles such as fluororesin, for example, with one kind or two kinds or different particle diameters are dispersed, so that a surface layer is formed. In this embodiment, the intermediary transfer belt 44*b* has a volume resistivity of 5×10^8 to 1×10^14[Ω, cm] (23° C., 50% RH) and a hardness of MD1 hardness of 60 to 85° (23° C., 50% RH). In this embodiment, the static friction coefficient of the intermediary transfer belt 44*b* is 0.15 to 0.6 (23° C., 50% RH, type 94i manufactured by HEIDON).

On the outer peripheral surface side of the intermediary transfer belt 44*b*, an outer secondary transfer roller 45*b* which constitutes the secondary transfer device 45 in cooperation with the inner secondary transfer roller 45*a* is disposed. The outer secondary transfer roller 45*b* contacts the intermediary transfer belt 44*b* and forms a secondary transfer portion (secondary transfer nip portion) N between the intermediary transfer belt 44*b*. The toner image formed on the intermediary transfer belt 44*b* is secondarily transferred onto the recording material S by the action of the secondary transfer device 45 in the secondary transfer portion N. In this embodiment, a positive secondary transfer voltage is applied to the outer secondary transfer roller 45*b* so that the negative toner image on the intermediary transfer belt 44*b* is secondarily transferred onto the recording material S which is nipped and fed between the intermediary transfer belt 44*b* and the outer secondary transfer roller 45*b*. The recording material S is fed from a feeding portion (not shown) in parallel with the above-described toner image forming operation, and the toner image on the intermediary transfer belt 44*b* is fed by the registration roller 80 provided in the feeding path at the timing adjusted. The sheet is then fed to the secondary transfer portion N.

As described above, the secondary transfer device 45 includes an inner secondary transfer roller 45*a* as a counter member, and an outer secondary transfer roller 45*b* which is a roller-type secondary transfer member as a secondary transfer portion. The inner secondary transfer roller 45*a* is disposed opposite to the outer secondary transfer roller 45*b* with the intermediary transfer belt 44*b* interposed therebetween. To the outer secondary transfer roller 45*b*, a secondary transfer power supply 76 as applying means (FIG. 2) is connected. During the secondary transfer process, the secondary transfer power source 76 applies a DC voltage having a polarity opposite to the normal charging polarity of the toner (positive in this embodiment) to the outer secondary transfer roller 45*b* as secondary transfer bias (secondary transfer voltage). The secondary transfer power source 76 is connected to a voltage detection sensor 76*a* for detecting the output voltage and a current detection sensor 76*b* for detecting the output current (FIG. 2). The core of the inner secondary transfer roller 45*a* is connected to the ground potential. And, when the recording material S is supplied to the secondary transfer portion N, a secondary transfer voltage with constant-voltage-control having a polarity opposite to the normal charging polarity of the toner is applied to the outer secondary transfer roller 45*b*. In this embodiment, a secondary transfer voltage of 1 to 7 kV is applied, a current of 40 to 120 μA, for example is applied, and the toner image on the intermediary transfer belt 44*b* is secondarily transferred onto the recording material S. Here, in this embodiment, an alternative connection is that the inner secondary transfer roller 45*a* is connected to the ground potential, and a voltage is applied from the secondary transfer power source 76 to the outer secondary transfer roller 45*b*, but a voltage from the secondary transfer power source 76 is applied to the inner secondary transfer roller 45*a*, and the outer secondary transfer roller 45*b* is connected to the ground potential. In such a case, a DC voltage having the same polarity as the normal charging polarity of the toner is applied to the inner secondary transfer roller 45*a*.

In this embodiment, the outer secondary transfer roller 45*b* has an elastic layer of ion conductive foam rubber (NBR rubber) and a core metal. The outer diameter of the outer secondary transfer roller 45*b* is, for example, 20 to 25 mm. In addition, as the outer secondary transfer roller 45*b*, a roller having an electric resistance value of 1×10^5 to 1×10^8Ω (measured at N/N (23° C., 50% RH), 2 kV applied) can be preferably used.

The recording material S onto which the toner image has been transferred is fed to a fixing portion 46 as fixing means. The fixing portion 46 includes a fixing roller 46*a* and a pressure roller 46*b*. The fixing roller 46*a* includes therein a heater as a heating means. The recording material S carrying the unfixed toner image is heated and pressed by being sandwiched and fed between the fixing roller 46*a* and the pressure roller 46*b*. By this, the toner image is fixed (melted and fixed) on the recording material S. Here, the temperature of the fixing roller 46*a* (fixing temperature) is detected by a fixing temperature sensor 77 (FIG. 2).

The recording material S on which the toner image is fixed is fed through a discharge path in a discharge portion (not shown), is discharged through a discharge port, and then stacked on a discharge tray provided outside the apparatus main assembly 10. In addition, between the fixing portion 46 and the discharge opening of the discharge portion, a reverse feeding path (not shown) for turning over the recording material S on which the toner image is fixed on the first surface and for supplying the recording material S to the secondary transfer portion N again. Z). The recording material S re-supplied to the secondary transfer portion N by the operation of the reverse feeding path is discharged onto the outside of the apparatus main assembly 10 after the toner image is transferred and fixed on the second side. As described above, the image forming apparatus 1 of this embodiment is capable of executing automatic double-sided printing which forms images on both sides of a single recording material S.

The surface of the photosensitive drum 51 after the primary transfer is electrically discharged by the pre-exposure device 54. In addition, the toner remaining on the photosensitive drum 51 without being transferred onto the intermediary transfer belt 44*b* during the primary transfer process (primary untransferred residual toner) is removed from the surface of the photosensitive drum 51 by the cleaning blade 55 and is collected in a collection container (not shown). The cleaning blade 55 is a plate-like member which is in contact with the photosensitive drum 51 with a predetermined pressing force. The cleaning blade 55 is in contact with the surface of the photosensitive drum 51 in a counter direction in which the outer end portion of the free end portion faces the upstream side in the rotational direction of the photosensitive drum 51. In addition, toner remaining on the intermediary transfer belt 44*b* without being transferred onto the recording material S during the secondary transfer process (secondary untransferred residual toner) or adhering matter such as paper dust is removed and collected from the surface of the intermediary transfer belt 44*b* by the belt cleaning device 60.

FIG. 2 is a block diagram showing a schematic structure of a control system of the image forming apparatus 1 of this embodiment. As shown in FIG. 2, the controller 30 is constituted by a computer, and includes, for example, a CPU 31, a ROM 32 for storing a program for controlling each unit, a RAM 33 for temporarily storing data, and an input/output circuit (I/F) 34 for inputting/outputting signals to and from the outside. The CPU 31 is a microprocessor which controls the entire image forming apparatus 1 and is a main part of the system controller. The CPU 31 is connected to the feeding portion (not shown), the image forming portion 40, the discharge portion (not shown), and the operation portion 70 via the input/output circuit 34, and exchanges signals with these portions, and controls the operation of each of these portions. The ROM 32 stores an image formation control sequence for forming an image on the recording material S. The controller 30 is connected to a charging bias power source 73, a developing bias power source 74, a primary transfer power source 75, and a secondary transfer power source 76, which are controlled by signals from the controller 30, respectively. In addition, the controller 30 is connected to a temperature sensor 71, a humidity sensor 72, a voltage detection sensor 75*a* and a current detection sensor 75*b* of the primary transfer power supply 75, a voltage detection sensor 76*a* and a current detection sensor 76*b* of the secondary transfer power supply 76, and a fixing temperature sensor 77.

The operating portion 70 includes an operation button as input means, and a display portion 70*a* including a liquid crystal panel as display means. Here, in this embodiment, the display unit 70*a* is constituted as a touch panel, and also has a function as input means. The operators such as users and service personnel can execute the print job (a series of operations to form and output an image or images on one or more recording materials S in response to one start instruction) by operating the operation portion 70. The controller 30 receives the signal from the operating portion 70 and operates various devices of the image forming apparatus 1. The image forming apparatus 1 can also execute a print job on the basis of an image forming signal (image data, control command) supplied from an external device 200 such as a personal computer.

In this embodiment, the controller 30 includes an image formation pre-preparation process portion 31*a*, an ATVC control process portion 31*b*, an image formation process portion 31*c*, and an adjustment process portion 31*d*. In addition, the controller 30 includes a primary transfer voltage storage portion 31*e*, a secondary transfer voltage storage portion 31*f*, and a chart storage portion 31*g*. Here, each of these process portions and storage portions may be provided as a portion or portions of the CPU 31 or the RAM 33. The controller 30 can execute a print job as described above. In addition, the controller 30 can execute ATVC control (setting mode) for the primary transfer portion and the secondary transfer portion (details of the ATVC control will be described hereinafter). In addition, the controller 30 can execute an adjustment mode for adjusting the set voltage of the secondary transfer voltage (details of the adjustment mode will be described hereinafter).

2. ATVC Control 2-1. ATVC Control of Primary Transfer Portion

Figure 3:
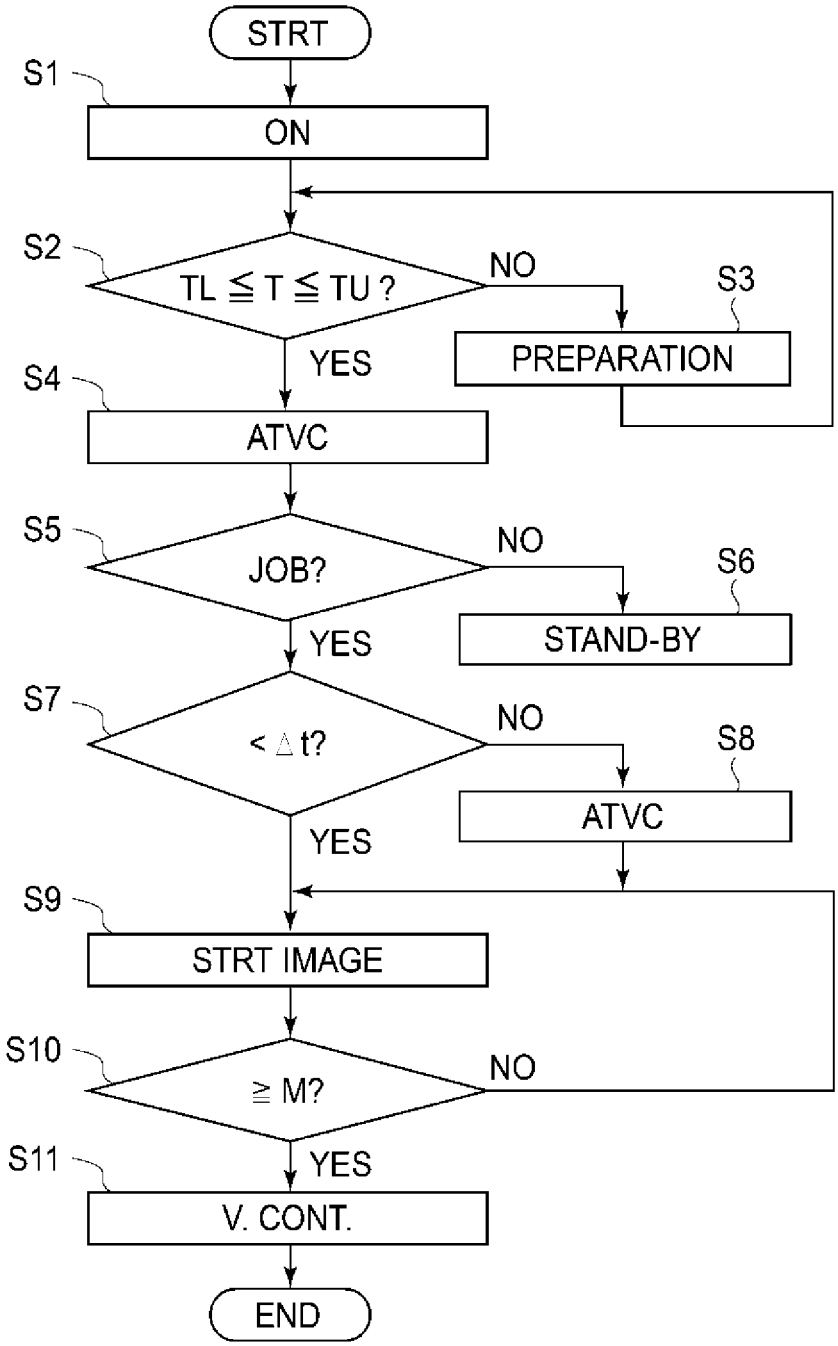
FIG. 3 is a flowchart showing an outline of the print job process.

Referring to FIG. 2 and FIG. 3, the control of the primary transfer voltage will be described in detail.

Generally, the primary transfer voltage control includes constant-voltage-control and constant-current-control, and in this embodiment, the constant-voltage-control is used. For each color, a table of target values (targets) of the primary transfer current corresponding to the installation environment of the apparatus main assembly 10 is stored in advance in the primary transfer voltage storage portion 31*e*. In this embodiment, the target current for each color is 55 μA. In the primary transfer portion 48, current flows in the thickness direction of the intermediary transfer belt 44*b* from the primary transfer roller 47 (direction from the primary transfer roller 47 to the photosensitive drum 51), and therefore, if the electric resistance of the primary transfer roller 47 and the intermediary transfer belt 44*b* is changed, a desired current does not flow. ATVC control of the primary transfer portion 48 is executed to correct this change in electrical resistance, in which at the time of the pre-multi-rotation process after power-on or the pre-rotation process before image formation, a predetermined current is supplied to measure the voltage (acquire information on electrical resistance).

FIG. 3 is a flowchart showing an outline of the procedure for controlling the print job in this embodiment. As shown in FIG. 3, when the power of the image forming apparatus 1 is turned on (S1), the CPU 31 acquires the detection value of the fixing temperature sensor 77 and determines whether the fixing temperature is not less than TL and not more than TU (S2). In this embodiment, TL=160° C. And TU=180° C., for example. However, the temperatures TL and TU are not limited to these temperatures. When the CPU 31 determines in a step S2 that the fixing temperature is not less than TL and not more than TU, the CPU 31 inputs an execution signal for the pre-image-formation preparation process to the pre-image-formation preparation process portion 31*a*. By this, an image formation preparation process portion 31*a* performs an image formation preparation process such as heating by the heater of the fixing portion 46 (S3). If it is determined in step S2 that the fixing temperature is TL or higher and TU or lower, the CPU 31 determines that the fixing temperature adjustment condition is satisfied, starts the pre-rotation process, and executes ATVC control (setting mode) of the primary transfer portion 48 (S4), in the pre-rotation process.

When executing ATVC control of the primary transfer portion 48, the CPU 31 inputs an ATVC control execution signal for the primary transfer portion 48 to the ATVC control process portion 31*b*. By this, the ATVC control for the primary transfer portion 48 is executed by the ATVC control process portion 31*b*. In the ATVC control for the primary transfer portion 48, the photosensitive drum 51 is charged in the same manner as in a normal image forming process, and multiple levels of voltage are applied to each primary transfer roller 47, and the current at that time is detected by the current detection sensor 75*b*. In addition, from the relationship between the applied voltage and the detected current, the primary transfer voltage Vtr is determined so that the target current to be outputted is obtained. For example, in the ATVC control for the primary transfer portion 48, first, a voltage of 2000V is applied to the primary transfer roller 47, and the current at that time is measured. If the current is smaller than the target current, next, a predetermined voltage higher than 2000V, for example, 3000V is applied, and the current at that time is measured. And, each measurement result of the current when 2000V and 3000V are applied is linearly approximated to obtain a voltage value that will be the target current, here 55 μA. In this embodiment, the voltage value obtained here is used as the initial value of the primary transfer voltage Vtr applied during image formation. In this embodiment, the ATVC control process portion 31*b* performs the above-described ATVC control for each color, and stores the set value of the primary transfer voltage Vtr in the primary transfer voltage storage portion 31*e*. Here, the voltages applied to acquire the relationship between voltage and current in ATVC control are not limited to two different voltages, and may be three or more different voltages. In addition, in this embodiment, the output voltage value of each primary transfer power source 75 is acquired by the ATVC control process portion 31*b*, but may be acquired by each of the voltage detection sensors 75*a*.

Next, the CPU 31 determines whether there is a job signal (step S5). If the CPU 31 determines in step S5 that there is no job signal, the CPU 31 enters standby mode and waits for the job signal (step S6). When CPU 31 determines that there is a job signal in step S5, CPU 31 determines whether or not the elapsed time since the previous execution of ATVC control is smaller than a predetermined elapsed time Δt (Step S7). In this embodiment, Δt=30 minutes, for example. However, the elapsed time Δt is not limited to this time. If it is determined in step S7 that the elapsed time since the previous ATVC execution is not shorter than the predetermined elapsed time Δt, the CPU 31 executes ATVC control (setting mode) for the primary transfer portion 48 in the same manner as described above (step S8). If it is determined in step S7 that the elapsed time since the previous execution of ATVC control is shorter than the predetermined elapsed time Δt, or it is after executing ATVC control in step S8, the CPU 31 inputs an image formation execution signal to the image formation process portion 31*c*. By this, image forming operation is started by the image forming process portion 31*c* (step S9).

When image forming operation is started, the CPU 31 determines whether or not the number of formed images is M or more (step S10). In this embodiment, M=28×N+1 (N=1, 2, 3, . . . ). If the CPU 31 determines in step S10 that the number of image formations is less than M, it continues image forming operation. If the CPU 31 determines in step S10 that the number of formed images is M or more, it performs voltage correcting operation in the period of the interval between the adjacent sheets (step S11). That is, in this embodiment, the current flowing through the primary transfer portion 48 is measured for each 28 sheet interval during the continuous image forming operation. And, on the basis of the measurement result between the sheets, the primary transfer voltage Vtr applied during the subsequent image formation is corrected to a voltage obtained by adding or subtracting ΔV to or from the current primary transfer voltage Vtr. This ΔV is a voltage corresponding to the difference between the target current and the current measured during the sheet interval, for example, which is obtained from the relationship between the voltage and current obtained by ATVC control.

Here, in this embodiment, the primary transfer current is set to all environments, all colors, and a target current thereof is 55 μA. In addition, in this embodiment, the primary transfer voltage is variable in the range of 0.5 to 7.0 kV.

2-2. ATVC Control of Secondary Transfer Portion.

Referring to FIG. 2, the control of the secondary transfer voltage will be described in detail. The control of the secondary transfer voltage is similar to the control of the primary transfer voltage. Generally, secondary transfer voltage control includes constant-voltage-control and constant-current-control, and in this embodiment, constant-voltage-control is used. A table of secondary transfer current target values (targets) corresponding to the installation environment of the apparatus main assembly 10 is stored in advance in the secondary transfer voltage storage portion 31*f*. In the secondary transfer portion N, a current flows in the thickness direction of the intermediary transfer belt 44*b* from the outer secondary transfer roller 45*b* (direction from the outer secondary transfer roller 45*b* to the inner secondary transfer roller 45*a*). Therefore, if there is a change in the electrical resistance of the outer secondary transfer roller 45*b*, the intermediary transfer belt 44*b*, and the inner secondary transfer roller 45*a*, a desired current does not flow. In order to correct against this change in electrical resistance, the ATVC control for the secondary transfer portion N is executed when a voltage is measured by supplying a predetermined current (acquire information regarding electrical resistance). In this embodiment, the ATVC control of the secondary transfer portion N is executed at a timing after the ATVC control for the primary transfer portion 48 in synchronization with the execution timing of the ATVC control for the primary transfer portion 48 described using the flowchart of FIG. 3.

When executing the ATVC control of the secondary transfer portion N, the CPU 31 inputs an execution signal for the ATVC control for the secondary transfer portion N to the ATVC control process portion 31*b*. By this, ATVC control in the secondary transfer portion N is executed by the ATVC control process portion 31*b*. In the ATVC control for the secondary transfer portion N, the photosensitive drum 51 is charged in the same manner as in a normal image forming process, a plurality of levels of voltages are applied to the outer secondary transfer roller 45*b*, and the current at each time is detected by the current detection sensor 76*b*. In addition, from the relationship between applied voltage and current, said partial transfer voltage Vb is determined so that the target current to be outputted is obtained. The process for acquiring the relationship between the voltage and the current and determining the transfer part voltage Vb is the same as the process for determining the primary transfer voltage Vtr in the ATVC control of the primary transfer portion. The ATVC control process portion 31*b* stores the value of the transfer part voltage Vb set by the ATVC control as described above in the secondary transfer voltage storage portion 31*f* Here, the voltages applied to acquire the relationship between voltage and current in ATVC control are not limited to two different voltages, and may be three or more different voltages. In addition, in this embodiment, the output voltage value of the secondary transfer power source 76 is acquired by the ATVC control process portion 31*b*, but alternatively, it may be acquired by the voltage detection sensor 76*a*.

The secondary transfer is performed with the recording material S sandwiched in the secondary transfer portion N, and therefore, the impedance is higher by the amount of recording material S than when ATVC control is performed, with the result that a desired secondary transfer current cannot flow at the transfer partial voltage Vb. Therefore, in this embodiment, considering the increase in impedance due to recording material S, the secondary transfer voltage value to be applied during image formation is obtained by adding recording material part voltage Vp necessary for flowing desired secondary transfer current to the transfer part voltage Vb obtained by ATVC control. In this embodiment, a table of values of the recording material part voltage Vp corresponding to the type of the recording material S and the installation environment of the apparatus main assembly 10 is stored in advance in the secondary transfer voltage storage portion 31*f* When the operator selects the type of recording material S used for image formation from the external device 200 such as the operation portion 70 or personal computer, the ATVC control process portion 31*b* selects the recording material part voltage Vp depending on the type of the recording material S. And, the ATVC control process portion 31*b* calculates Vb+Vp as the set voltage of the secondary transfer voltage at the time of image forming operation, and stores it in the secondary transfer voltage storage portion 31*f*. In this embodiment, the voltage value Vb+Vp obtained here is used as the default value of the secondary transfer voltage applied during image forming operation. Here, the type of recording material S can be characterized based on general characteristics such as plain paper, thick paper, thin paper, glossy paper, coated paper, and any distinguishable information such as manufacturer, brand, product number, basis weight, and thickness.

3. Outline and Problem of Simple Adjustment Mode for Secondary Transfer Voltage.

Next, an outline of the simple secondary transfer voltage adjustment mode (output mode for outputting a chart) will be described. Depending on the type and condition of the recording material S used in image formation, the moisture content and electrical resistance value of the recording material S may differ greatly from the standard recording material S. In this case, optimal transfer may not be performed with the set voltage of the secondary transfer voltage using the default recording material part voltage Vp set in advance as described above.

That is, first, the secondary transfer voltage needs to be a voltage necessary for transferring the toner from the intermediary transfer belt 44*b* to the recording material S. In addition, the secondary transfer voltage must be suppressed to a voltage level with which the abnormal discharge does not occur. However, depending on the type and state of the recording material S actually used for image formation, the electrical resistance may be higher than the value assumed as a standard value. In such a case, the voltage required to transfer the toner from the intermediary transfer belt 44*a* to the recording material S may be insufficient with the set secondary transfer voltage using the preset default recording material part voltage Vp. Therefore, in this case, it is desired to increase the set voltage of the secondary transfer voltage by increasing the recording material part voltage Vp. On the contrary, depending on the type and condition of the recording material S actually used for image formation, the moisture content of the recording material S may have decreased, with the result that the electrical resistance is lower than the value assumed as a standard value, and therefore, the electrical discharge may be likely to occur. In this case, with the setting voltage of the secondary transfer voltage using the preset default recording material part voltage Vp, image defects may occur due to the abnormal discharge. Therefore, in this case, it is desirable to lower the set voltage of the secondary transfer voltage by reducing the recording material part voltage Vp.

Therefore, it is desired that the operator such as a user or a service person adjusts (changes) the recording material part voltage Vp depending on the recording material S actually used for image formation, for example, to optimize the setting voltage of the secondary transfer voltage during the actual image formation. This adjustment may be performed by the following method. That is, for example, the operator outputs the images while switching the secondary transfer voltage for each recording material S, and confirms the presence or absence of an image defect occurring in the output image to obtain an optimal secondary transfer voltage, on the basis of which the optimum secondary transfer voltage is determined. However, in this method, since the outputting operation of the image and the setting operation for the secondary transfer voltage are repeated, the recording material S which is wasted increases, and it takes time.

Under the circumstances, in this embodiment, the image forming apparatus 1 is provided with a simple secondary transfer voltage adjustment mode (hereinafter also simply referred to as "adjustment mode"). In this adjustment mode, a chart having a plurality of representative color patches (test toner images, test patterns) is outputted on the recording material S which is actually used for image formation, while the secondary transfer voltage (more specifically, a recording material part voltage Vp) is switched for each patch. And, the optimal secondary transfer voltage (more specifically, the recording material part voltage Vp) is determined by checking the presence or absence of an image defect appearing in the outputted chart patch.

The larger the patch size of the chart that is outputted in the adjustment mode, the more advantageous it is since then it is easier to check for image defects. However, if the patch is large, the number of patches which can be formed on one recording material S is reduced. The patch shape can be square and so on. The color of the patch can be determined by the image defect to be checked and by the easiness of checking. For example, when the secondary transfer voltage is increased from a low value, the lower limit of the secondary transfer voltage can be determined from the voltage value at which the secondary color patches such as red, green, and blue can be properly transferred. In addition, when the secondary transfer voltage is further increased, the upper limit value of the secondary transfer voltage can be determined from the voltage value at which image failure occurs due to the high secondary transfer voltage in the halftone patch. And, the secondary transfer voltage can be set within the range between the upper limit value and the lower limit value.

Here, problems in the conventional adjustment mode will be described. As described in the foregoing, in the conventional adjustment mode as described in JP-A-2000-221803, for example, as shown in part (a) of FIG. 17 of this application, a chart having a relatively large margin at the end of the recording material and having a plurality of patches at the middle of the recording material has been used. Under the circumstances, an adjustment mode is performed using a chart as shown in part (b) of FIG. 17 of the present application, and image defects in subsequent image formation are inspected. In the chart of part (b) of FIG. 17, one blue solid patch 301 and one black solid patch 302, and two halftone patches 303 are arranged in a direction substantially perpendicular to the feeding direction of the recording material S (hereinafter also referred to as "thrust direction"). In addition, eleven sets of patch sets 301 to 303 in the thrust direction are arranged in the feeding direction of the recording material S. Each patch has a 25.7 mm×25.7 mm square shape (one side is approximately parallel to the thrust direction), and the spacing between the patches in the recording material S feeding direction is 9.5 mm. And, this chart was formed at the center of the A3 size recording material (paper) S in the thrust direction (the margin at the end in the thrust direction was 50 mm or more). Here, margins are also provided at the leading and trailing ends of the recording material S in the feed direction. At the time of output of this chart, the default value is set to 0 (reference), and the secondary transfer voltage is switched from a low value to a high value for each patch set 301 to 303 from the leading end toward the trailing end in the feeding direction of the recording material S, at the intervals of 11 levels from −5 to 0 to +5. Here, the difference in the secondary transfer voltage for each level was 150V. As a result, even if the secondary transfer voltage is set to a level that is free of a problem on the chart in part (b) of FIG. 17, an image defect may occur on the image (particularly halftone image) formed on the end portion of the recording material S, in subsequent image formation using the same type of recording material S.

The cause of such image defects is considered as follows. That is, since moisture tends to escape at the end of the recording material S, only the end of the recording material S has a high electrical resistance value, and abnormal discharge is likely to occur during transfer. In addition, the end portion of the recording material S absorbs moisture only at the end of the recording material S, and the end of the recording material S is undulated with the result that the abnormal discharge is likely to occur sometimes. At this time, the image defect at the end of the recording material S does not occur only in the neighborhood of the edge of the recording material S, but starts to occur from the edge of the recording material S and often appears in a relatively wide range from 10 to 30 mm inside the recording material S. When the change in the state of the recording material S is large, the image defect may occur over an inner region from the edge of the recording material S to about 50 mm inside. This is considered as being occurring because the state of the recording material S in the above-mentioned width region inside the end of the recording material S has changed from the state of the region further inside from the end of the recording material S. When using such a recording material S, even with the secondary transfer voltage where image defects did not occur in the halftone patch formed near the center of the recording material S, an image defect may occur at the end of the recording material S when an image covering substantially the entire surface of the recording material S is formed.

Therefore, there is a demand for an image forming apparatus capable of executing an adjustment mode capable of appropriately adjusting a transfer voltage even when the recording material S which tends to cause image defects at the end is used. In addition, the size of the recording material S used for image formation varies, and therefore, the adjustment mode is also required to be compatible with recording materials S of various sizes while suppressing the complexity of the structure and control.

4. Adjustment Mode of this Embodiment.

Figure 4:
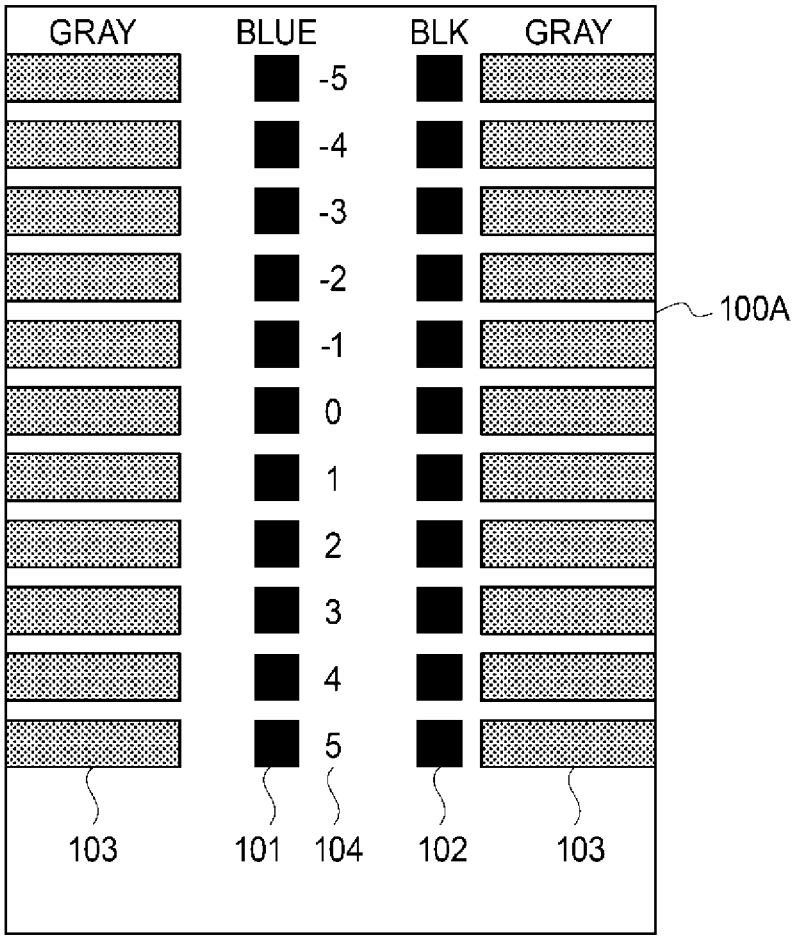
FIG. 4 is a schematic illustration of chart image data outputted in the adjustment mode.

Next, the adjustment mode in this embodiment will be described. First, a chart usable with the adjustment mode in this embodiment will be described. In the adjustment mode in this embodiment, two types of image data 100A and 100B shown in FIG. 4 and parts (a) and (b) of FIG. 5 are used for chart output. FIG. 4 shows chart image data (hereinafter also referred to as "large chart data") 100A outputted to the recording material S having a length in the feed direction of 420 to 487 mm FIG. 5 shows chart image data (hereinafter also referred to as "small chart data") outputted to the recording material S having a length in the feed direction of 210 to 419 mm. In this embodiment, as the chart image data, only two types of image data shown in FIGS. 4 and 5 are set. And, in the adjustment mode, the chart corresponding to the image data cut out from any one of the two types of image data shown in FIGS. 4 and 5 depending on the size of the recording material S to be used is outputted on the recording material S. At this time, in this embodiment, image data having a size obtained by subtracting the margins at the end of the recording material S (in this embodiment, both ends in the thrust direction and both ends in the feed direction) from the image data shown in FIGS. 4 and 5 is cut out. This margin is set to a small width which does not hinder the observation of the presence or absence of an image defect occurring at the end of the recording material S.

Here, in this embodiment, the maximum size (maximum sheet passing size) of the recording material S on which the image forming apparatus 1 can form an image is 13 inches× 19.2 inches (longitudinal feed). In addition, in the following description, the directions of the large chart data 100A and the small chart data 100B corresponding to the "feeding direction" and "thrust direction" of the recording material S are also referred to as "feeding direction" and "thrust direction", respectively.

The large chart data 100A shown in FIG. 4 will be further described. The large chart data 100A corresponds to the maximum sheet passing size of the image forming apparatus 1 of this embodiment, and the image size is approx. (thrust direction) 13 inches (≈330 mm) at the short side×(feeding direction) 19.2 inches (≈487 mm) at the long side. When the size of the recording material S is 13 inches×19.2 inches (vertical feed) or less and more than A3 size (vertical feed), the part to which this large chart data 100A is cut according to the size of the recording material S is outputted. That is, when the length of the recording material S in the feeding direction is 420 to 487 mm, the large chart data 100A is used. At this time, in this embodiment, the image data is cut out from the large chart data 100A in accordance with the size of the recording material S based on the leading end center. That is, the leading end portion in the feeding direction of the recording material S and the leading end portion (upper end portion) in the long side direction of the large chart data 100A are aligned with each other, the center in the thrust direction of the recording material S and the center in the short side direction of the large chart data 100A are aligned with each other, and the image data is cut out of the large chart data 100A. In addition, at this time, in this embodiment, the image data is cut out from the large chart data 100A such that a margin of 2.5 mm is provided at the ends of the recording material S (both ends in the thrust direction and both ends in the feed direction in this embodiment). For example, part (a) of FIG. 6 is a schematic illustration of the chart 110 outputted to the recording material S of A3 size (vertical feed) (short side 297 mm×long side 420 mm) on the basis of the large chart data 100A. In this case, the image data having a size of 292 mm (short side)×415 mm (long side) is cut out from the large chart data 100A. And, the image corresponding to the cut-out image data is outputted on an A3 size recording material S with a margin of 2.5 mm at each end portion with the leading end center being the reference position.

The large chart data 100A includes one blue solid patch 101, one black solid patch 102, and two halftone patches 103 (gray (black halftone) in this embodiment) arranged in the thrust direction. Two halftone patches 103 are arranged at both ends in the thrust direction, and between the two halftone patches 103, one blue solid patch 101 and one black solid patch 102 are arranged. And, eleven sets of patch sets 101 to 103 in the thrust direction are arranged in the feed direction. The blue solid patch 101 and the black solid patch 102 are each 25.7 mm×25.7 mm square (one side is substantially parallel to the thrust direction). In addition, each of the halftone patches 103 at both ends has a width of 25.7 mm in the feed direction, and extends to the end of the large chart data 100A in the thrust direction. In addition, the interval between the patch sets 101 to 103 in the feed direction is 9.5 mm. The secondary transfer voltage is switched at the timing when the portion on the chart corresponding to this interval passes through the secondary transfer portion N. The 11 patch sets 101-103 in the feed direction of the large chart data 100A are within the range of 387 mm in the feed direction such that when the size of the recording material S is A3, they are within the length 415 mm of the recording material S in the feed direction. In addition, in this example, the large chart data 100A includes identification information 104 for identifying the setting of the secondary transfer voltage applied to each patch set in conjunction with each of 11 patch sets 101 to 103 in the feed direction. In this embodiment, this identification information 104 is arranged near the center in the thrust direction, in particular, between the blue solid patch 101 and the black solid patch 102 in the thrust direction. In addition, in this embodiment, eleven pieces of identification information 104 (−5 to 0 to +5 in this embodiment) corresponding to eleven steps of secondary transfer voltage settings are provided.

The size of the patch is required to be large enough to permit the operator to easily determine whether there is an image defect or not. For the transferability of blue solid patch 101 and black solid patch 102, if the size of the patch is small, it can be difficult to discriminate the defect, and therefore, the size of the patch is preferably 10 mm square or more, and is more preferably 25 mm square or more. The image defects due to abnormal discharge which occur when the secondary transfer voltage is increased in the halftone patch 103 are often in the form of white spots. This image defect tends to be easy to discriminate even in a small size image, compared to the transferability of the solid image. However, it is easier to observe if the image is not too small, and therefore, in this embodiment, the width of the halftone patch 103 in the feed direction is the same as the width of the blue solid patch 101 and the black solid patch 102 in the feed direction. In addition, the interval between the patch sets 101 to 103 in the feed direction may be set so that the secondary transfer voltage can be switched. In addition, the margin of the end of the recording material S (particularly the end in the thrust direction) is selected so as not to interfere with the presence of image defects occurring at the end of the recording material S (particularly the end in the thrust direction). As described in the foregoing, image defects which occur at the end of the recording material S occur in an area of 10 to 30 mm inside from the edge, and in the case of a large area, an area of about 50 mm inward; they do not occur only in a narrow region such as a margin of 2.5 mm in this embodiment, for example. Therefore, even if the chart is outputted with a margin of about 2 to 10 mm provided at the end of the recording material S (particularly, the end in the thrust direction), an image defect at the end of the recording material S can be sufficiently confirmed. Here, it is preferable to prevent patches from being formed in the neighborhood of the leading and trailing ends of the recording material S in the feeding direction (for example, in the range of about 20 to 30 mm inward from the edge). The reason for this will be described. That is, of the end portions in the feeding direction of the recording material S, there may be an image defect that does not occur at the end portion in the thrust direction but occurs only at the leading end or the trailing end. This is because in this case, it may be difficult to determine whether or not an image defect has occurred because the secondary transfer voltage is changed. In this embodiment, the halftone patch 103 is formed in an area within 50 mm inside from the edge in the width direction of the recording material S. Here, preferably, with respect to the width direction of the recording material S, the recording material S is formed with the image in an area within 10 mm to 30 mm inner from the edge. However, the leading end portion and the neighborhood of the trailing end portion of the recording material S in the feeding direction (an area 30 mm inward from the edge) is excluded. In addition, in this embodiment, the halftone corresponds to a toner application amount of 10% to 80% when the toner application amount of the solid patch is 100%.

Using the large chart data 100A described above, as the size of the recording material S becomes smaller than 13 inches (A3 size or more), the length, in the thrust direction, of the halftone patch 103 at both ends in the thrust direction becomes smaller (part (a) in FIG. 7)). In addition, using the large chart data 100A as described above, as the size of the recording material S becomes smaller than 13 inches (however, A3 size or more), the margin at the trailing end in the feed direction becomes smaller (part (a) in FIG. 7). Here, the length of the halftone patch 103 in the feeding direction is substantially constant irrespective of the size of the recording material S. In addition, the sizes of the blue solid patch 101 and the black solid patch 102 are substantially constant irrespective of the size of the recording material S.

As described above, in this embodiment, the inner patch (first patch) of which the size of the patch does not change even if the size of the recording material S changes are a blue solid patch 101 and a black solid patch 102. In addition, in this embodiment, the end portion patch (second patch) of which the size changes as the size of the recording material S changes is a gray (black halftone) patch 103. Here, a solid image is an image with the maximum density level.

The small chart data 100B shown in FIG. 5 will be further described. The small chart data 100B corresponds to a size smaller than the A3 size, and the image size is approximately long side (thrust direction) 13 inches (≈330 mm)×short side (feeding direction) 210 mm. If the size of the recording material S is A5 (short side 148 mm×long side 210 mm) (longitudinal feed) or more and smaller than A3 size (longitudinal feed), a chart corresponding to the image data cut out of the small chart data 100B depending on the size of the recording material S is outputted. That is, when the length of the recording material S in the feed direction is 210 to 419 mm, the small chart data 100B is used. At this time, in this embodiment, the image data is cut out of the small chart data 100B in accordance with the size of the recording material S on the basis of the leading end center. That is, the leading end in the feeding direction of the recording material S and the leading end (upper end) in the short side direction of the small chart data 100B are aligned with each other, and the center in the thrust direction of the recording material S and the center in the long side direction of the small chart data 100B are aligned with each other, and then the image data is cut out from the small chart data 100B. In addition, at this time, in this example, as with the large chart data 100A, image data is cut out from the small chart data 100B so as to be provided with a margin of 2.5 mm at the ends of the recording material S (both ends in the thrust direction and both ends in the feed direction in this embodiment). As will be described hereinafter, the small chart data 100B is smaller in length in the feed direction than the large chart data 100A, and therefore, the number of patch sets which can be arranged in the feed direction is smaller than that of the large chart data 100A. Therefore, when the small chart data 100B is used, two charts are outputted in order to increase the number of patches. For example, when the size of the recording material S is B4 size (short side 257 mm×long side 364 mm) (vertical feed), two charts 110 as shown in part (b) of FIG. 6 are outputted.

The small chart data 100B has the same patches as those of the large chart data 100A. That is, in the small chart data 100B, one blue solid patch 101, one black solid patch 102, and two halftone patches 103 are arranged in the thrust direction. Two halftone patches (gray in this example) 103 are arranged at opposite ends in the thrust direction, and between the two halftone patches 103, one blue solid patch 101 and one black solid patch 102 are arranged. And, five sets of patch sets 101 to 103 in the thrust direction are arranged in the feed direction. The blue solid patch 101 and the black solid patch 102 are each 25.7 mm×25.7 mm squares (one side is substantially parallel to the thrust direction). In addition, each of the halftone patches 103 at both ends has a width of 25.7 mm in the feed direction, and extends to the end of the small chart data 100B in the thrust direction. In addition, the interval between the patch sets 101 to 103 in the feed direction is 9.5 mm. The secondary transfer voltage is switched at the timing when the portion of the chart corresponding to this interval passes through the secondary transfer portion N. The five patch sets 101 to 103 in the feeding direction of the small chart data 100B are arranged in a range of 167 mm in length in the feeding direction. In addition, in this example, the small chart data 100B is provided with identification information 104 for identifying the setting of the secondary transfer voltage applied to each set of patch sets, in association with the respective ones of the five patch sets 101 to 103 in the feed direction. In this embodiment, the identification information 104 is arranged near the center in the thrust direction, in particular, between the blue solid patch 101 and the black solid patch 102 in the thrust direction. As described above, when the small chart data 100B is used, two charts are outputted. And, on the first sheet, based on the small chart data 100B shown in part (a) of FIG. 5, five pieces of identification information 104 (−4 to 0 in this embodiment) corresponding to the setting of the lower secondary transfer voltage in five steps are arranged. In addition, on the second sheet, based on the small chart data 100B shown in part (b) of FIG. 5, five (1 to 5 in this embodiment) pieces of identification information 104 corresponding to higher five-level secondary transfer voltage settings are arranged.

Using the above small chart data 100B, as the size of the recording material S becomes smaller (however, smaller than the A3 size and larger than the A5 size), the length, in the thrust direction, of the halftone patch 103 at both ends in the thrust direction becomes smaller (FIG. 7), part (b)). In addition, using the small chart data 100B as described above, as the size of the recording material S becomes smaller (however, smaller than the A3 size and larger than the A5 size), the margin at the trailing end in the feed direction becomes smaller (part (b) of FIG. 7). Here, the length of the halftone patch 103 in the feeding direction is substantially constant irrespective of the size of the recording material S. In addition, the sizes of the blue solid patch 101 and the black solid patch 102 are substantially constant irrespective of the size of the recording material S.

Here, in this embodiment, not only a standard size but also an arbitrary size (A5 size or more, 13 inches×19.2 inches or less) recording material S is usable by an operator inputting and designating on the operation portion 70 or the external device 200.

Next, referring to FIGS. 8-10, the operation in the adjustment mode will be described. FIG. 8 is a flowchart showing an outline of the process of the adjustment mode in this embodiment. In addition, FIG. 9 is a functional block diagram illustrating the operation of the adjustment process portion 31*d* in this embodiment. In addition, FIG. 10 is a schematic illustration of an example of a setting screen for changing the secondary transfer voltage or the like in the adjustment mode. Here, a case where the operator executes the adjustment mode operation using the operation portion 70 of the image forming apparatus 1 will be described as an example.

First, the operator selects the type and size of the recording material S using used with the adjustment mode (step S101). At this time, the adjustment process portion 31*d* causes the setting receiving portion 51 to display a setting screen (not shown) for the type and size of the recording material S on the operation portion 70. The setting receiving portion 51 acquires information on the type and size of the recording material S designated by the operator in the operation portion 70. Here, for information on the type and size of the recording material S, for example, the information may be acquired by selecting the cassette of the feeding portion which contains the recording material S, in which the type and size of the recording material S is set in advance in association with the cassette.

Next, the operator sets the central voltage value of the secondary transfer voltage applied at the time of chart output, and whether to output the chart to one side or both sides of the recording material S (step S102). In this embodiment, in order to be able to adjust the secondary transfer voltage during secondary transfer to the front side (first side) and back side (second side) in duplex printing, the chart can be outputted on both sides of the recording material S also in the adjustment mode. Therefore, in this example, it is possible to select whether to output the chart to one side or both sides of the recording material S, and the center voltage value of the secondary transfer voltage can also be set for each of the front side and the back side of the recording material S. At this time, the adjustment process portion 31*d* causes the setting reception portion 51 to display an adjustment mode setting screen 80 as shown in FIG. 10. The setting screen 80 has a voltage setting portion 81 for setting the center voltage value of the secondary transfer voltage for the front and back sides of the recording material S. In addition, the setting screen 80 has an output side selection portion 82 for selecting whether to output the chart to one side or both sides of the recording material S. Furthermore, the setting screen 80 includes an output instruction portion (test page output button) 83 for instructing chart output, a confirmation portion 84 (OK button 84*a* or the apply button 84*b*) for confirming the setting, and a cancel button 85 for canceling the setting change. When adjustment value 0 is selected in voltage setting portion 81, a preset voltage (more specifically, the recording material part voltage Vp) set in advance for the currently selected recording material S is selected. And, the case that adjustment value 0 is selected will be considered in which 11 sets of patches from −5 to 0 to +5 when large chart data is used, and 10 sets of patches from −4 to 0 to +5 when small chart data is used, are switched and applied as the secondary transfer voltages. In this embodiment, the difference in secondary transfer voltage for one level is 150V. The setting receiving portion 51 acquires information related to the setting such as the center voltage value set by way of the setting screen 80 in the operation portion 70.

Next, the chart is outputted by the operator selecting the output instruction portion 83 on the setting screen 80 (step S103). At this time, the adjustment process portion 31*d* cuts the chart data (FIGS. 4 and 5) stored in advance in the chart storage portion 31*g* on the basis of the size information of the recording material S acquired by the setting reception portion 51, by the cutting portion 52, and the image is fed to the image forming process portion 31*c* (FIG. 2). In addition, the adjustment process portion 31*d* sends the information on the center voltage value acquired by the setting reception portion 51 and the information as to one side or both sides to the image forming process portion 31*c*. And, when the setting receiving portion 51 receives a chart output instruction, the adjustment processing portion 31*d* instructs the image forming process portion 31*c* to output the chart. The image forming process portion 31*c* performs predetermined control using the information acquired from the adjustment process portion 31*d*, the information on the recording material part voltage Vp stored in the secondary transfer voltage storage portion 31*f*, and the like, and outputs the chart. For example, it is assumed that A3 size double-sided coated paper with a basis weight of 350 $g/m^2$ is selected, and the preset recording material part voltage Vp in the current environment is 2500V. In this case, large chart data is used, the secondary transfer voltage is switched every 150V from 1750V to 3250V, and 11 sets of patches are output on one chart.

Next, the operator determines the optimum secondary transfer voltage based on the observation of the outputted chart (steps S104, S105). When the secondary transfer voltage is increased from a low value, the lower limit value of the secondary transfer voltage can be determined from the voltage value at which the blue (secondary color) solid patch 101 can be appropriately transferred. In addition, when the secondary transfer voltage is further increased, the upper limit value of the secondary transfer voltage can be determined from the voltage value at which an image defect occurs due to the high secondary transfer voltage in the black solid patch 102 and the halftone patch 103. And, the secondary transfer voltage can be set in a range between the upper limit value and the lower limit value. Typically, the operator confirms the identification information 104 of the patch set in which all patches are transferred at a sufficient density without the image defects (such as uneven image density) in each of the patches 101, 102, 103 (or the lowest occurrence). If the confirmed identification information 104 is "0", it is not necessary to change the center voltage value. On the other hand, if the confirmed identification information 104 is other than "0", the secondary transfer voltage (more specifically, the recording material part voltage Vp) can be changed by changing the setting of the center voltage value on the setting screen 80. In addition, if there is no preferred set voltage in the outputted chart, the setting of the center voltage value can be changed on the setting screen 80 and the chart can be outputted again.

That is, if the operator determines that there is no optimum secondary transfer voltage setting voltage, the process returns to step S102, and the operator changes the optimum secondary transfer based on the change of the center voltage value setting, and outputs the chart again, and the observation of the chart is performed again. The proper voltage can be determined (step S102 to step S105). On the other hand, when the operator determines that there is an optimum secondary transfer voltage setting voltage (specifically, identification information 104 mounted to the patch set), the operator changes (or maintains if necessary) the value of the voltage setting portion 81 on the setting screen 80 to a value corresponding to the set voltage (step S106). And, the operator selects the confirmation portion 84 on the operation screen 80 (S107) to finish the adjustment mode operation. At this time, then, the adjustment process portion 31*d* causes the setting change portion 53 to store information on the set voltage of the secondary transfer voltage in the secondary transfer voltage storage portion 31*f* as follows. That is, when the confirmation portion 84 of the setting screen 80 is selected, the setting change portion 53 changes the set value for the currently selected recording material S to the secondary transfer voltage value (more specifically, the recording material part voltage Vp) corresponding to the center voltage value set in the voltage setting portion 81 of the setting screen 80. And, the setting change portion 53 stores the set value in the secondary transfer voltage storage portion 31*f*.

Here, the image forming apparatus may be capable of a full output mode, in which all of the 41 patch sets corresponding to the adjustment value ±20 level of the secondary transfer voltage provided in the image forming apparatus 1 are continuously outputted at a time as a plurality of charts.

In addition, here, the adjustment mode is executed when an operation is performed by the operator by way of the operation portion 70 of the image forming apparatus 1, as an example, but the adjustment mode may be executed by performing the operation by way of the external device 200 such as a personal computer. In this case, by the driver program of the image forming apparatus 1 installed in the external device 200, the same setting as described above can be performed by way of a setting screen displayed on the display portion of the external device 200.

When the adjustment mode according to this embodiment was executed for various recording materials S, an image defect at the end of the recording material S in the thrust direction on the chart was confirmed in some cases. And, when the set voltage of the secondary transfer voltage was then changed to suppress the image defect, it was confirmed that image defects at the end of the recording material S in the thrust direction could be suppressed in the subsequent image formation using the same type of recording material S.

Here, as for the color of the patch, blue solid, black solid, and gray (black halftone) are used in this embodiment, but the present invention is not limited to this example. For example, instead of blue, secondary colors such as red and green can be used, and solid colors of yellow, magenta, cyan and black can be used. In addition, instead of the black halftone, a patch of a color or density which tends to cause an image defect in the image forming apparatus may be used.

In addition, in this example, as a result of examining the arrangement and size of the patch, the setting is such that if the recording material S on which the chart is outputted is A5 sheet (vertical feed) (thrust width is 148 mm), the halftone patch 103 disappeared. And, the end of the recording material S is not a halftone patch 103, but is a blue solid patch 101 and a black solid patch 102. If the patch at the end of the recording material S in the thrust direction is a color such as blue solid or black solid, the discrimination is more difficult than in the case using halftone, as described above, but it is possible to determine to some extent the image defect at the end of the recording material S in the thrust direction. As described above, when outputting a chart using a recording material S of some size among the recording materials S usable in the image forming apparatus 1, end patch that changes in size when recording material S changes size may disappear when the size of the recording material S changes.

In addition, in this embodiment, the margins are provided at both ends in the chart feeding direction, but the margins may not be provided at one or both ends in the chart feeding direction. In addition, in this embodiment, the margins are provided at both ends in the thrust direction of the chart, but no margins may be provided at one end or both ends in the thrust direction of the chart.

In addition, in this embodiment, the patches at the end in the thrust direction of the chart (gray patches in the above embodiment) are provided at both ends in the same direction. However, in the image forming apparatus, when an image defect occurs at one end in the thrust direction of the recording material, an image defect often occurs at the other end, and when no image defect occurs at one end or the other end, the image defects do not occur in the other areas in many cases. In such a case, the patch at the end in the thrust direction of the chart (corresponding to the gray patch in the above embodiment) may be provided only at one end in the thrust direction of the chart.

As described above, the image forming apparatus 1 of this embodiment includes a controller 30 which controls the output mode with which a predetermined chart 110 including a plurality of test toner images formed along the feeding direction of the recording material S and transferred with different transfer voltages is outputted. In this embodiment, the plurality of test toner images are formed at the end in the thrust direction perpendicular to the feeding direction of the recording material S, and it has a plurality of end portion test toner images 103 composed of halftones transferred with different transfer voltages. And, when outputting the maximum size chart, the controller 30 forms a plurality of end portion test toner images 103 in an area within 50 mm from the edge in the thrust direction of the recording material S. When the maximum size chart is outputted, the controller 30 preferably forms a plurality of end portion test toner images 103 in an area within 30 mm from the edge in the thrust direction of the recording material S. In addition, in this example, in the thrust direction, multiple end portion test toner images 103 are continuously formed from the edge of the recording material S or from the edge of the recording material S to a position further inside by 10 mm or less. In addition, the controller 30 can output identification information 104 for identifying the test toner image in the output mode. This identification information is formed further on the inner side with respect to the thrust direction of the recording material S than the end portion test toner image 103.

In addition, in this embodiment, the controller 30 changes the length, in the thrust direction, of the plurality of end portion test toner images 103 depending on the length, in the thrust direction, of the recording material S used for the output of the chart 110. In addition, in the controller 30, in this embodiment, the lengths in the feed direction of the plurality of end portion test toner images 103 are substantially constant irrespective of the size of the recording material S used for the output of the chart 110. In addition, in this embodiment, the image forming apparatus 1 includes a storage portion (chart storage portion) 31*g* which stores chart data 100A and 100B, which are image data for outputting the chart 110. And, in accordance with the size of the recording material S used for the output of the chart 110, the controller 30 controls so that the chart 110 is outputted on the basis of the image data of the area cut out from the chart data 100A and 100B. At this time, the area cut out from the chart data 100A, 100B is further inward in the thrust direction in the case where the length in the thrust direction of the recording material S used for the output of the chart 110 is a second length shorter than the first length, than the case where the length is the first length. In addition, in this embodiment, the chart 110 has center portion test toner images 101, 102, which are other test toner images formed inside the end test toner image 103 in the thrust direction of the recording material S. In this embodiment, irrespective of the size of the recording material S used for the output of the chart 110, the sizes of the central portion test toner images 101 and 102 are substantially constant. In this embodiment, the end portion test toner image 103 is an image having a lower density than the central portion test toner images 101 and 102. In addition, in this embodiment, the central portion test toner images 101 and 102 are solid images. In addition, in this embodiment, the central portion test toner image 101 is a secondary color image.

As has been described in the foregoing, according to this embodiment, in the adjustment mode, the chart including the inner patch disposed at the center of the recording material S in the thrust direction and the end patch disposed at the end is output. Therefore, according to this embodiment, even when the recording material S in which an image defect is likely to occur at the end is used, the secondary transfer voltage can be appropriately adjusted. In addition, according to this embodiment, the adjustment mode can output charts including inner patches and end patches on recording materials S of various sizes on the basis of image data cut out from two types of preset chart image data. Therefore, according to this embodiment, the adjustment mode can cover the recording materials of various sizes with a relatively simple structure and control.

Embodiment 2

Next, another embodiment of the present invention will be described.

The basic structure and operation of the image forming apparatus of this embodiment are the same as those of the image forming apparatus of Embodiment 1. Therefore, as to the image forming apparatus of this embodiment, elements including the same or corresponding functions or structures as those of the image forming apparatus of Embodiment 1 are denoted by the same reference numerals as those of Embodiment 1, and detailed description thereof is omitted for simplicity.

In Embodiment 1, the chart outputted in the adjustment mode is observed by the operator such as a user or a service personnel, and the operator inputs an instruction to adjust the set voltage of the secondary transfer voltage, depending on the observation. On the other hand, in this embodiment, the chart is read by a reading means, and on the basis of the result of the reading, the set voltage of the secondary transfer voltage is adjusted by the controller 30 of the image forming apparatus 1. Here, in this embodiment, the operator can further adjust the set voltage.

FIG. 11 is a schematic cross-sectional view of the image forming apparatus 1 according to this embodiment. The image forming apparatus 1 of this embodiment includes an in-line image sensor 90 serving as a reading portion for reading the image on the recording material S and is provided downstream of the fixing portion 46 in the feeding direction of the recording material S. In this embodiment, the structure is such that the image sensor 90 can read an image density of an image on the recording material S, particularly an image density of the patch on the chart, at 1200 dpi (that is, it can convert optically acquired information into an electrical signal).

Referring to FIG. 12 and FIG. 13, the operation in the adjustment mode will be described. FIG. 12 is a flowchart showing an outline of the process of the adjustment mode in this embodiment. In addition, FIG. 13 is a functional block diagram illustrating the operation of the adjustment process portion 31*d* in this embodiment. Here, a case where the operator executes the adjustment mode using the operation portion 70 of the image forming apparatus 1 will be described, as an example.

First, the adjustment process portion 31 accepts the setting of the type and size of the recording material S used in the adjustment mode by the operator in the operation portion 70 as in Embodiment 1 (step S201). Next, the adjustment process portion 31 outputs the central voltage value of the secondary transfer voltage applied when the chart is output by the operator at the operation portion 70 and the chart to one side of the recording material S in the same manner as in Embodiment 1 (step S202). Next, in the same manner as in Embodiment 1, the adjustment process portion 31 outputs the chart when receiving an instruction to output the chart from the operator in the operation portion 70 (step S203). The above-described settings and instructions by the operator are performed by way of a setting screen 80 displayed on the operation portion 70 as shown in FIG. 10, and it is received by the setting reception portion 51.

Next, the adjustment process portion 31*d* acquires information on the chart read by the image sensor 90 in the determination portion 54 (step S204). And, in the adjustment process portion 31*d*, the determination portion 54 determines an optimum set voltage of the secondary transfer voltage on the basis of the information on the image density of each patch on the chart (step S205). At this time, the determination portion 54 cuts out each patch of the read chart image and discriminates a change in the image density of the patch. For the halftone patch 103, the image at the position of the halftone patch 103 on the chart is cut out in interrelation with the size of the recording material S, and the change in the halftone image density is discriminated. For example, the determination portion 54 can determine the secondary transfer voltage setting voltage with the smallest change in image density of each patch constituting each patch set 101 to 103, as the optimum secondary transfer voltage setting voltage.

Next, the adjustment process portion 31 reflects the determined setting voltage (center voltage value) of the secondary transfer voltage on the setting screen 80 displayed on the operation portion 70 (step S206). Here, the operator can check the outputted chart. Therefore, if the visual judgment result of the operator is different from the judgment result by the judgment portion 54 reflected in the setting screen 80, the operator can change the set voltage (center voltage value) of the secondary transfer voltage determined by the determination portion 54 by way of the setting screen 80. In addition, if the optimum secondary transfer voltage setting voltage is not found in the outputted chart, the operator can change the center voltage value and output the chart again in the same manner as in Embodiment 1.

Next, the adjustment process portion 31*d* maintains or changes the set voltage (center voltage value) of the secondary transfer voltage determined by the determination portion 54, so that the operator selects the confirmation portion 84 on the setting screen 80 to confirm, and if the confirmed instruction is accepted by the setting reception portion 51, the adjustment mode is completed. At this time, the adjustment process portion 31*d* causes the setting change portion 53 to store information of the set voltage of the secondary transfer voltage in the secondary transfer voltage storage portion 31*f* as follows. That is, the setting changing portion 53 outputs, as the set value used for the currently selected recording material S, the secondary transfer voltage value (more specifically, the recording material part voltage Vp) corresponding to the center voltage value set by the voltage setting portion 81 on the setting screen 80 when the confirmation instruction is inputted. And, the setting change portion 53 stores the set value in the secondary transfer voltage storage portion 31*f*.

Here, as in Embodiment 1, all 41 patch sets corresponding to the secondary transfer voltage adjustment value of ±20 levels provided in the image forming apparatus 1 are outputted in succession at a time as multiple charts (full output mode). In addition, for reading the chart, an original reading device provided in the image forming apparatus 1 for the copying function may be used.

As described above, in this embodiment, the image forming apparatus 1 includes the reading means 90 for reading the chart 110. And, in this embodiment, the controller 30 adjusts the transfer voltage on the basis of the information on the density of the test toner image on the chart 110 read by the reading portion 90.

As has been described in the foregoing, according to this embodiment, the same effects as those of Embodiment 1 can be provided, and the work burden of the chart determination by the operator can be reduced.

Embodiment 3

Next, another embodiment of the present invention will be described. The basic structure and operation of the image forming apparatus of this embodiment are the same as those of the image forming apparatus of Embodiment 1. Therefore, as to the image forming apparatus of this embodiment, elements including the same or corresponding functions or structures as those of the image forming apparatus of Embodiment 1 are denoted by the same reference numerals as those of Embodiment 1, and detailed description thereof is omitted.

Part (a) of FIG. 14 is a schematic illustration of large chart data 100A used in the adjustment mode in this embodiment. The large chart data 100A in this embodiment is different from the large chart data 100A in Embodiment 1 in the halftone patches 103 arranged at both ends in the thrust direction. In the large chart data 100A of this embodiment, the halftone patch 103 has a shape of 25.7 mm×25.7 mm square (one side is substantially parallel to the thrust direction). Here, in this embodiment, the image size of the large chart data 100A, the setting of the blue solid patch 101, the black solid patch 102, the identification information 104, and the like are substantially the same as those of the large chart data 100A of Embodiment 1.

Part (b) of FIG. 14 is a schematic illustration of the chart 110 output to the recording material S of A3 size (vertical feed) based on the large chart data 100A of part (a) of FIG. 14. In this embodiment as well, as in Embodiment 1, basically the large chart data 100A is cut out on the basis of the leading end center depending on the size of the recording material S. However, in this embodiment, as shown in part (b) of FIG. 14, depending on the size of the recording material S, the relative position of the halftone patch 103 with respect to the center of the recording material S in the thrust direction (the center of the chart data in the thrust direction) changes. That is, when the recording material S of 13 inches×19 inches (vertical feed) is used, the distance from the center in the thrust direction to the halftone patch 103 is defined as La (part (a) in FIG. 14). In addition, when the recording material S of A3 size (vertical feed) is used, the distance from the center in the thrust direction to the halftone patch 103 is Lb (part (b) of FIG. 14). At this time, when the recording material S of A3 size is used, the chart is moved by moving the halftone patch 103 in the large chart data 100A toward the end in the thrust direction of the recording material S so that Lb<La and is outputted.

Parts (a) and (b) of FIG. 15 are schematic illustrations of small chart data 100B used in the adjustment mode in this embodiment. The small chart data 100B in this embodiment is different from the small chart data 100B in Embodiment 1 in the halftone patches 103 positioned at both ends in the thrust direction. Similar to the large chart data 100A in this embodiment, in the small chart data 100B of this embodiment, the halftone patch 103 has a shape of 25.7 mm×25.7 mm square (one side is substantially parallel to the thrust direction). Here, the settings of the image size of the small chart data 100B, the blue solid patch 101, the black solid patch 102, the identification information 104, and the like in this embodiment are substantially the same as those of the small chart data 100B of Embodiment 1. Part (a) of FIG. 15 shows data used for outputting the first chart, and part (b) of FIG. 15 shows data used for outputting the second chart.

Part (c) of FIG. 15 is a schematic illustration of the chart 110 outputted to the recording material S of B4 size (vertical feed) on the basis of the small chart data 100B of part (a) of FIG. 15. In addition, part (d) of FIG. 15 is a schematic illustration of a chart 110 outputted to a recording material of A4 size (vertical feed) based on the small chart data 100B of part (b) of FIG. 15. In this embodiment as well as in Embodiment 1, the small chart data 100B is basically cut out on the basis of the center of the leading end depending on the size of the recording material S, and is used. Also, in the present embodiment, as in Embodiment 1, the small chart data 100B is basically cut out and used on the basis of the center of the leading end depending on the size of the recording material S. In this embodiment, however, as shown in parts (c) and (d) of FIG. 15, depending on the size of the recording material S, the relative position of the halftone patch 103 with respect to the center of the recording material S in the thrust direction (the center of the chart data in the thrust direction) changes. That is, the distance from the center, in the thrust direction, to the halftone patch 103 in the case of using the recording material S of B4 size (vertical feed) is Lc (part (c) of FIG. 15). In addition, when the recording material S of A4 size (vertical feed) is used, the distance from the center in the thrust direction to the halftone patch 103 is Ld (part (d) in FIG. 15). Here, La is the distance from the center, in the thrust direction, to the halftone patch 103 in the small chart data 100B. At this time, when the recording material S of B4 size is used, the chart of the halftone patch 103 in the small chart data 100B is moved and outputted so as to approach the end of the recording material S in the thrust direction so that Lc<La. Similarly, when the A4—size recording material S is used, the chart is outputted such that Ld (<Lc<La).

Here, also in this embodiment, as in Embodiment 1, a margin may be provided at the end of the chart.

Even when the chart of this embodiment is used, the operation in the adjustment mode can be the same as that of Embodiment 1 or Embodiment 2. FIG. 16 is a functional block diagram illustrating the operation of the adjustment process portion 31*d* in this embodiment. In this embodiment, the adjustment process portion 31*d* includes a moving portion 55 which moves the halftone patch 103 in the chart data depending on the size of the recording material S instead of the cutting portion 52 which cuts out the chart data in Embodiments 1 and 2.

As described above, in this embodiment, the controller 30 changes the interval between the central portion test toner images 101 and 102 and the end test toner image 103 in accordance with the size of the recording material S used for the chart output. In this embodiment, the controller 30 changes the relative position of the end portion test toner image 103 with respect to the center of the recording material S in the thrust direction, depending on the length of the recording material S used in output of the chart 110 in the thrust direction. In this embodiment, with the controller 30, the size of the end portion test toner image 103 is substantially constant irrespective of the size of the recording material S used for the output of the chart 110. In addition, in this embodiment, the image forming apparatus 1 includes a storage portion 31*g* which stores chart data 100A and 100B, which are image data for outputting the chart 110. And, the controller 30 moves the end test toner image 103 in the chart data 100A and 100B so as to approach the end in the thrust direction of the recording material S depending on the size of the recording material S used for the output of the chart 110. The chart is outputted on the basis of the moved image data. At this time, as compared with the case that the length, in the thrust direction, of the recording material S used for the outputting of the chart 110 is the first length, the distance by which the end portion test toner image 103 is moved in the chart data 100A and 100B is longer than in the case that it is the second length shorter than the first length.

As has been described in the foregoing, according to this example, the same effect as in Embodiment 1 or Embodiment 2 can be obtained with the reduced toner consumption by chart output, and it is advantageous in reducing the running cost of the image forming apparatus 1. In addition, according to this embodiment, it may be easier to determine the presence or absence of an image defect because of a narrower patch area for the operator to view.

According to the present invention, the transfer voltage can be appropriately adjusted even when a recording material which tends to cause image defects at the end portion is used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-219771 filed on Nov. 22, 2018, which is hereby incorporated by reference herein in its entirety.

What is claimed is:

1. An image forming apparatus comprising:

an image bearing member for carrying a toner image;

an image transfer device configured to transfer the toner image from said image bearing member to a recording material;

an application device configured to apply a transfer voltage to said image transfer device; and a controller configured to execute an operation in an output mode in which a chart, in which a plurality of test toner images transferred with different transfer voltages are formed, is outputted to adjust the transfer voltage, wherein when outputting a maximum size of the chart, the plurality of test toner images includes a plurality of first test toner images and a plurality of second test toner images, the first test toner images comprising halftone images arranged in a feeding direction of the recording material and transferred with different transfer voltages, the plurality of second test toner images having a higher density than that of the plurality of first test toner images, being arranged in the feeding direction of the recording material at positions between the plurality of first test toner images in a width direction perpendicular to the feeding direction of the recording material, and being transferred with different transfer voltages, the plurality of first test toner images being formed in areas within 50 mm from both ends of the chart in the width direction.

2. An image forming apparatus according to claim 1, wherein the plurality of first test toner images are formed in areas within 30 mm from both ends of the chart in the width direction.

3. An image forming apparatus according to claim 1, wherein the plurality of first test toner images are continuously formed 10 mm or more from both ends of the chart in the width direction.

4. An image forming apparatus according to claim 1, wherein said controller changes the width of the plurality of first test toner images, depending on the width of the recording material used for outputting the chart.

5. An image forming apparatus according to claim 1, wherein said controller keeps the dimensions of the plurality of test toner images in the feeding direction substantially constant, irrespective of the size of the recording material used for the output of the chart.

6. An image forming apparatus according to claim 1, further comprising a storage portion for storing chart data comprising image data for outputting the chart, wherein said controller outputs the chart based on cut-out image data of an area cut out from the chart data, depending on the size of the recording material used for outputting the chart.

7. An image forming apparatus according to claim 1, wherein said controller keeps the size of the plurality of second test toner images substantially constant irrespective of the size of the recording material used for outputting the chart.

8. An image forming apparatus according to claim 1, wherein the plurality of second test toner images are solid images.

9. An image forming apparatus according to claim 1, wherein the plurality of second test toner images are formed from multiple color images.

10. An image forming apparatus according to claim 1, wherein said controller changes the interval between the plurality of second test toner images and the plurality of first test toner images depending on the size of the recording material used for outputting the chart.

11. An image forming apparatus according to claim 1, further comprising a reading device for reading the chart, wherein the controller adjusts the transfer voltage based on information relating to a density of the plurality of test toner images of the chart read by said reading device.

12. An image forming apparatus according to claim 1, wherein the plurality of first test toner images are of the same color.

13. An image forming apparatus according to claim 1, wherein the plurality of first test toner images are of black color.

* * * * *